US007518526B2

(12) United States Patent
Newman

(10) Patent No.: US 7,518,526 B2
(45) Date of Patent: Apr. 14, 2009

(54) METHOD AND SYSTEM FOR DISPLAYING SCANNING DATA FOR OIL WELL TUBING BASED ON SCANNING SPEED

(75) Inventor: Frederic M. Newman, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 0 days.

(21) Appl. No.: 11/691,219

(22) Filed: Mar. 26, 2007

(65) Prior Publication Data

US 2008/0037368 A1 Feb. 14, 2008

Related U.S. Application Data

(60) Provisional application No. 60/786,658, filed on Mar. 28, 2006.

(51) Int. Cl.
*G01V 3/00* (2006.01)

(52) U.S. Cl. ..... 340/853.1; 340/853.2; 340/853.3; 340/853.9; 340/854.4; 166/53; 166/77.51; 702/6

(58) Field of Classification Search ..... 340/853.1, 340/853.2, 853.3, 853.5, 853.7, 853.9, 854.4, 340/854.5; 702/5, 6, 28, 45; 166/53, 77.51
See application file for complete search history.

(56) References Cited

U.S. PATENT DOCUMENTS

| | | | | |
|---|---|---|---|---|
| 5,193,628 | A * | 3/1993 | Hill et al. | 175/45 |
| 5,237,539 | A | 8/1993 | Selman | |
| 6,021,093 | A | 2/2000 | Birchak et al. | |
| 6,347,292 | B1 * | 2/2002 | Denny et al. | 702/188 |
| 6,760,665 | B1 * | 7/2004 | Francis | 702/6 |
| 2005/0267686 | A1 * | 12/2005 | Ward | 702/6 |

* cited by examiner

*Primary Examiner*—Hung T. Nguyen
(74) *Attorney, Agent, or Firm*—King & Spalding LLP

(57) ABSTRACT

A method for analyzing a tubing section with multiple sensors at a consistent speed to improve the analysis and grading of tubing retrieved from an oil well. An analysis speed can be pre-set or input based on the tubing being analyzed and the sensors employed. The analysis data can be retrieved and charted based on whether the data was obtained within the required analysis speed. The data can then be displayed for grading and color-coded based on the data obtained within the required ranged and that obtained outside the range. Further, the display can remove the data obtained outside the required range and link together the remaining data to improve the grading process of the tubing sections.

41 Claims, 14 Drawing Sheets

METHOD AND SYSTEM FOR DISPLAYING SCANNING DATA FOR OIL WELL TUBING BASED ON SCANNING SPEED

This application claims benefit of U.S. Provisional Application Ser. No. 60/786,658, filed on Mar. 28, 2006

FIELD OF THE INVENTION

The present invention relates to methods of analyzing oil field tubing as it is being inserted into or extracted from an oil well. More specifically, the invention relates to a method for analyzing tubing sections at a substantially consistent, pre-set speed and displaying the analysis data obtained under the required speed conditions.

BACKGROUND

After drilling a hole through a subsurface formation and determining that the formation can yield an economically sufficient amount of oil or gas, a crew completes the well. During drilling, completion, and production maintenance, personnel routinely insert and/or extract devices such as tubing, tubes, pipes, rods, hollow cylinders, casing, conduit, collars, and duet into the well. For example, a service crew may use a workover or service rig to extract a string of tubing and sucker rods from a well that has been producing petroleum. The crew may inspect the extracted tubing and evaluate whether one or more sections of that tubing should be replaced due physical wear, thinning of the tubing wall, chemical attack, pitting, or another defect. The crew typically replaces sections that exhibit an unacceptable level of wear and note other sections that are beginning to show wear and may need replacement at a subsequent service call.

As an alternative to manually inspecting tubing, the service crew may deploy an instrument to evaluate the tubing as the tubing is extracted from the well and/or inserted into the well. The instrument typically remains stationary at the wellhead, and the workover rig moves the tubing through the instrument's measurement zone.

The instrument typical measures pitting and wall thickness and can identify cracks in the tubing wall. Radiation, field strength (electrical, electromagnetic, or magnetic), and/or pressure differential may interrogate the tubing to evaluate these wear parameters. The instrument typically samples a raw analog signal and outputs a sampled or digital version of that analog signal.

In other words, the instrument typically stimulates a section of the tubing using a field, radiation, or pressure and detects the tubing's interaction with or response to the stimulus. An element, such as a transducer, converts the response into an analog electrical signal. For example, the instrument may create a magnetic field into which the tubing is disposed, and the transducer may detect changes or perturbations in the field resulting from the presence of the tubing and any anomalies of that tubing.

While the instrument can provide important and detailed information about the damage or wear to the tubing, this data can be manipulated in a number of ways which limit its usefulness. For example, the speed of insertion or extraction of the tubing segment can have profound effect on the data retrieved by the instrument. For instance, if the same tubing section is pulled though the instrument at two widely varying speeds, the wear data will not be consistent, thus leaving open the opportunity for improperly determining the remaining life for that tubing section.

In addition, grading of the tubing sections is typically accomplished by an operator viewing the data obtained by an instrument. The entirety of the data may include data obtained at several different speeds, thus providing the operator with no possibility of providing an accurate grade to the tubing. Furthermore, since the conventional method of grading the tubing requires an operator to analyze the data, different operators typically grade the same data in different ways, thus providing inconsistent grading across multiple stands of tubing.

To address these representative deficiencies in the art, what is needed is an improved capability for evaluating tubing. For example, a need exists for a method of maintaining a consistent speed of removal of the tubing section during analysis to ensure consistent analysis data. Another need exists for a method of setting the speed of removal or insertion of a tubing section based on the type of tubing and the sensors being used to ensure the most accurate analysis of the tubing sections. A further need exists for a method of parsing the analysis data and displaying only that data that was obtained within the optimal speed range. A capability addressing one or more of these needs would provide more accurate, precise, repeatable, efficient, or profitable tubing evaluations.

SUMMARY OF THE INVENTION

The present invention relates to evaluating an item, such as a piece of tubing or a rod, in connection with placing the item into an oil well or removing the item from the oil well. Evaluating the item can comprise sensing, scanning, monitoring, inspecting, assessing, or detecting a parameter, characteristic, or property of the item.

In one aspect of the present invention, an instrument, scanner, or sensor can monitor tubing, tubes, pipes, rods, hollow cylinders, casing, conduit, collars, or duct near a wellhead of the oil well. The instrument can comprise a wall-thickness, rod-wear, collar locating, crack, imaging, or pitting sensor, for example. As a field service crew extracts tubing from the oil well or inserts the tubing into the well, the instrument can evaluate the tubing for defects, integrity, wear, fitness for continued service, or anomalous conditions. The instrument can provide tubing information in a digital format, for example as digital data, one or more numbers, samples, or snapshots. The tubing can be removed at a consistent pre-set speed based on the instrument and the type of tubing. By removing the tubing at a consistent known speed the instrument can provide a more consistent view of the wear on the tubing.

In another exemplary embodiment, the pre-set speed can be inserted into a computer and the distance needed by an oil service rig to accelerate to the consistent speed can be calculated. A section of the tubing can be lowered below the instrument a distance equal to the acceleration distance so that the tubing will be moving at the pre-set speed at the time it begins to pass the instrument. This will allow the entire tubing segment to be analyzed at the pre-set speed. Once the segment completely passes the instrument, the rig can be slowed down to a stop and the segment removed and the process can be repeated with the next segment of tubing.

In another exemplary embodiment, the computer can retrieve the analysis data from the instrument and the tubing removal speed data from an encoder on the oil service rig. The computer can determine which data was retrieved under the required speed and consistency requirements and parse that data from data retrieved outside the allowed parameters. The computer can then display the data obtained within the parameters so that the tubing section can be graded. The computer can complete the grading of the tubing section or an operator skilled in the art of grading can complete the step. If the analysis data is close to a threshold of two different grades, a determination can be made whether to analyze the tubing section again.

In another exemplary embodiment, the analysis data for multiple tubing sections can be retrieved an compared to the chemical treatments being applied to the well from which the tubing sections came. If the tubing sections are showing excessive wear compared to their age, the chemical treatment regimen can be modified based on the analysis data of the tubing sections from that well. In addition, wells that are similarly situated to the well being analyzed can have their chemical treatment regimens modified based on the analysis of the single well.

In another exemplary embodiment, an encoder can be placed at the retrieval drum of the oil service rig. Data from the encoder can be used to determine the linear depth or length for each tubing section. The depth data can be associated with analysis data and speed data. The computer can provide a display a chart showing analysis data against the depth of the tubing section from which the analysis data is obtained in order to determine if wear is different along the depth of the well.

The discussion of processing tubing data presented in this summary is for illustrative purposes only. Various aspects of the present invention may be more clearly understood and appreciated from a review of the following detailed description of the disclosed embodiments and by reference to the drawings and any claims that may follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by any accompanying claims.

Figure 1:
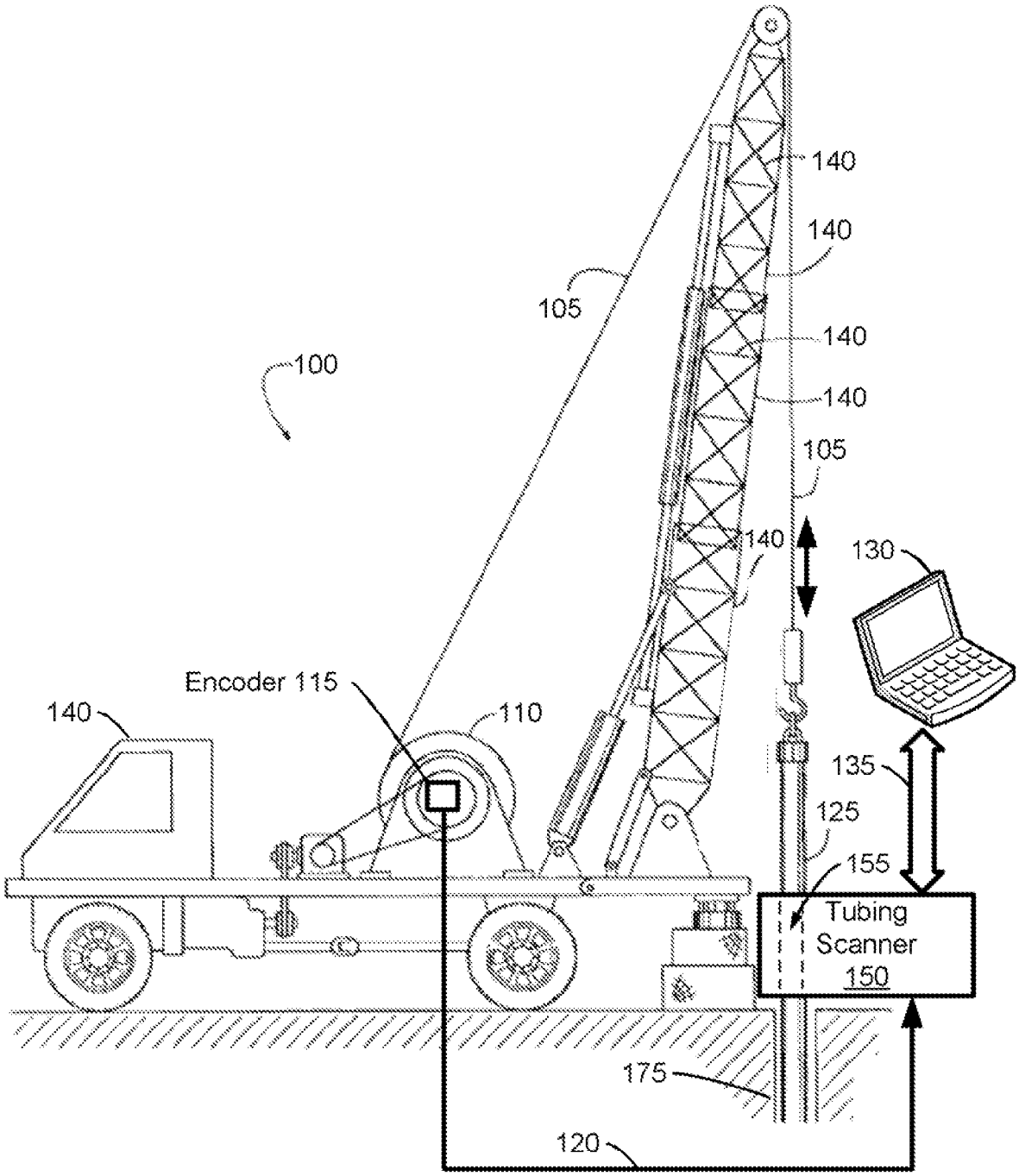
FIG. 1 is an illustration of an exemplary system for servicing an oil well that scans tubing as the tubing is extracted from or inserted into the well in accordance with an embodiment of the present invention.

Many aspects of the invention can be better understood with reference to the above drawings. The components in the drawings are not necessarily to scale. Instead, emphasis has been placed upon clearly illustrating the principles of the exemplary embodiments of the present invention. Moreover, in the drawings, reference numerals designate like or corresponding, but not necessarily identical, elements throughout the several views.

DETAILED DESCRIPTION OF EXEMPLARY EMBODIMENTS

The present invention supports methods for analyzing tubing sections from an oil well and displaying the analysis data to improve the tube grading process. Providing consistent reliable analysis data and displaying it in a consistent and easy to understand manner will help an oilfield service crew can make more efficient, accurate, and sound evaluations of how much life, if any, remains in each joint of tubing in a section of tubing.

Figure 2:
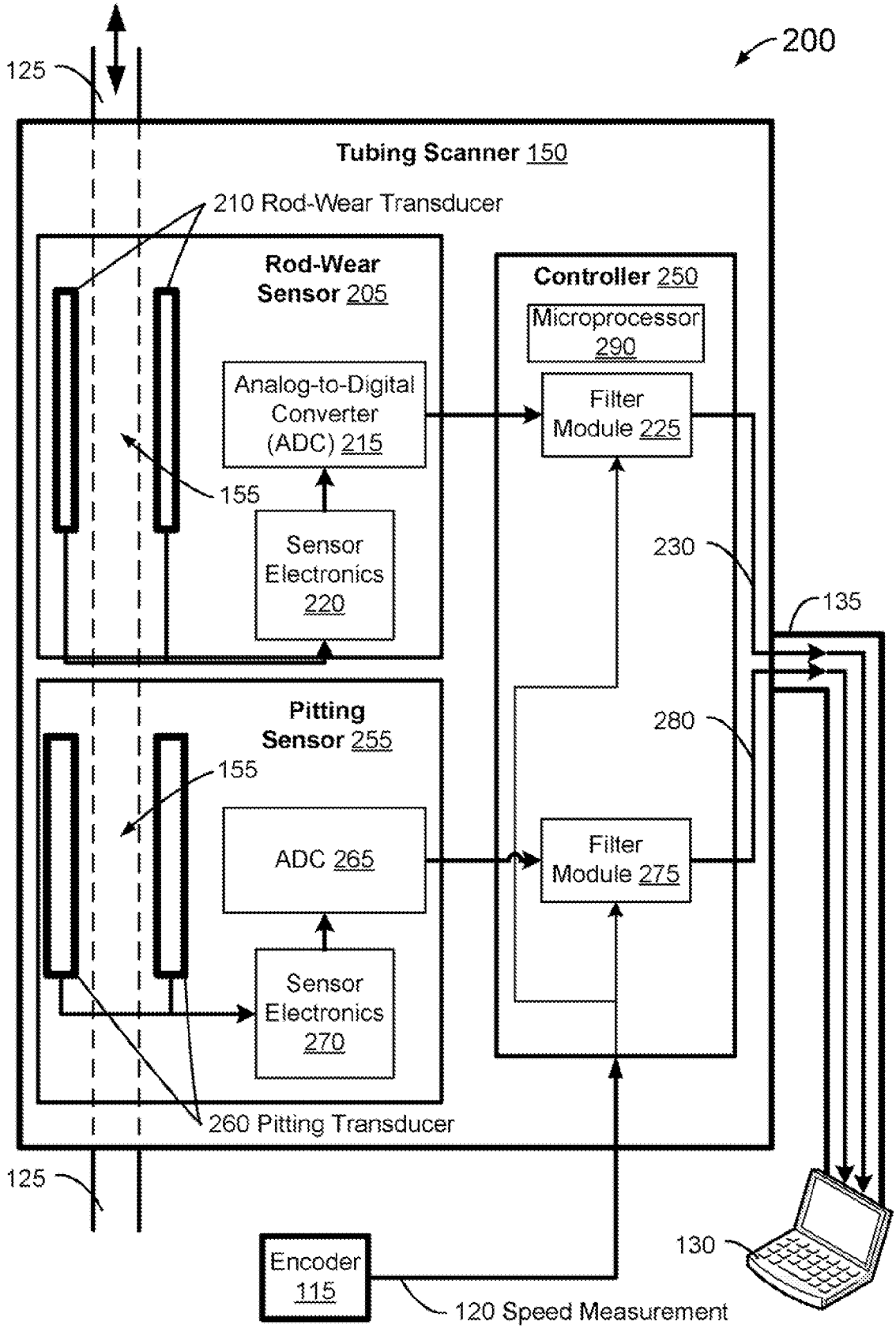
FIG. 2 is a functional block diagram of an exemplary system for scanning tubing that is being inserted into or extracted from an oil well in accordance with one exemplary embodiment of the present invention.

A method and system for processing tubing data will now be described more fully hereinafter with reference to FIGS. 1-13, which show representative embodiments of the present invention. FIG. 1 depicts a workover rig moving tubing through a tubing scanner in a representative operating environment for an embodiment the present invention. FIG. 2 provides a block diagram of a tubing scanner that monitors, senses, or characterizes tubing and flexibly processes the acquired tubing data. FIGS. 3-13 show flow diagrams, along with illustrative data and plots, of methods related to acquiring tubing data and processing the acquired data.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting, and among others supported by representations of the present invention.

Moreover, although an exemplary embodiment of the invention is described with respect to sensing or monitoring a tube, tubing, or pipe moving though a measurement zone adjacent to a wellhead, those skilled in the art will recognize that the invention may be employed or utilized in connection with a variety of applications in the oilfield or other operating environments.

Turning now to FIG. 1, this figure illustrates a system 100 for servicing an oil well 175 that scans tubing 125 as the tubing 125 is extracted from or inserted into the well 175 according to an exemplary embodiment of the present invention. The oil well 175 comprises a hole bored or drilled into the ground to reach an oil-bearing formation. The borehole of the well 175 is encased by a tube or pipe (not explicitly shown in FIG. 1), known as a "casing" that is cemented, to downhole formations and that protects the well 175 from unwanted formation of fluids and debris.

Within the casing is a tube 125 that carries oil, gas, hydrocarbons, petroleum products, and/or other formation fluids, such as water, to the surface. In operation, a sucker rod string (not explicitly shown in FIG. 1), disposed within the tube 125, forces the oil uphole. Driven by strokes from an uphole machine, such as a "rocking" pump jack, the sucker rod moves up and down to communicate reciprocal motion to a downhole pump (not explicitly shown in FIG. 1). With each stroke, the downhole pump moves oil up the tube 125 towards the wellhead.

As shown in FIG. 1, a service crew uses a workover or service rig 140 to service the well 175. During the illustrated procedure, the crew pulls the tubing 125 from the well 175, for example to repair or replace the downhole pump. The tubing 125 comprises a string of thirty-foot sections (approximately 9.12 meters per section), each of which may be referred to as a "joint." The joints screw together via unions, tubing joints, or threaded connections.

The crew uses the workover rig 140 to extract the tubing 125 in increments or steps, typically two joints per increment, known as a "section." The rig 140 comprises a derrick or boom 145 and a cable 105 that the crew temporarily fastens to the tubing section 125. A motor-driven reel 110, drum, winch, or block and tackle pulls the cable 105 thereby hoisting or lifting the tubing section 125 attached thereto. The crew lifts the tubing section 125 a vertical distance that approximately equals the height of the derrick 145, approximately sixty feet or two joints.

More specifically, the crew attaches the cable 105 to the tubing section 125, which is vertically stationary during the attachment procedure. The crew then lifts the tubing 125, typically in a continuous motion, so that two joints are extracted from the well 175 while the portion of the tubing section 125 below those two joins remains in the well 175. When those two joints are out of the well 175, the operator of the reel 110 stops the cable 105, thereby halting upward motion of the tubing 125. The crew then separates or unscrews the two exposed joints from the remainder of the tubing section 125 that extends into the well 175.

The crew repeats the process of lifting and separating two-joint sections of tubing 125 from the well 175 and arranges the extracted sections in a stack of vertically disposed joints, known as a "stand" of tubing 125. After extracting the full tubing section 125 from the well 175 and servicing the pump, the crew reverses the step-wise tube-extraction process by placing the tubing sections 125 back in the well 175. In other words, the crew uses the rig 140 to reconstitute the tubing sections 125 by threading or "making up" each joint and incrementally lowering the tubing sections 125 into the well 175.

The system 100 comprises an instrumentation system for monitoring, scanning, assessing, or evaluating the tubing 125 as the tubing 125 moves into or out of the well 175. The instrumentation system comprises a tubing scanner 150 that obtains information or data about the portion of the tubing 125 that is in the scanner's sensing or measurement zone 155. Via a data link 120, an encoder 115 provides the tubing scanner 150 with speed, velocity, and/or positional information about the tubing 125. That is, the encoder 115 is mechanically linked to the drum 110 to determine motion and/or position of the tubing 125 as the tubing 125 moves through the measurement zone 155.

As an alternative to the illustrated encoder 115 some other form of positional or speed sensor can determine the derrick's block speed or the rig engine's rotational velocity in revolutions per minute ("RPM"), for example. Exemplary methods for obtaining positional or speed data can include the use of a gelograph (not shown), a gelograph line (not shown), a measuring wheel riding on the fast line of the cable 105 (not shown), and a spoke counter on the crown sheave (not shown), as well as other methods and apparatus known to those of ordinary skill in the art.

Another data link 135 connects the tubing scanner 150 to a computing device, which can be a laptop 130, a handheld, a personal communication device ("PDA"), a cellular system, a portable radio, a personal messaging system, a wireless appliance, or a stationary personal computer ("PC"), for example. The laptop 130 displays data that the tubing scanner 150 has obtained from the tubing 125. The laptop 130 can present tubing data graphically, for example. The service crew monitors or observes the displayed data on the laptop 130 to evaluate the condition of the tubing 125. The service crew can grade the tubing 125 according to its fitness for continued service, for example.

The communication link 135 can comprise a direct link or a portion of a broader communication network that carries information among other devices or similar systems to the system 100. Moreover, the communication link 135 can comprise a path through the Internet, an intranet, a private network, a telephony network, an Internet protocol ("IP") network, a packet-switched network, a circuit-switched network, a local area network ("LAN"), a wide area network ("WAN"), a metropolitan area network ("MAN"), the public switched telephone network ("PSTN"), a wireless network, or a cellular system, for example. The communication link 135 can further comprise a signal path that is optical, fiber optic, wired, wireless, wire-line, waveguided, or satellite-based, to name a few possibilities. Signals transmitted over the link 135 can carry or convey data or information digitally or via analog transmission. Such signals can comprise modulated electrical, optical, microwave, radiofrequency, ultrasonic, or electromagnetic energy, among other energy forms.

The laptop 130 typically comprises hardware and software. That hardware may comprise various computer components, such as disk storage, disk drives, microphones, random access memory ("RAM"), read only memory ("ROM"), one or more microprocessors, power supplies, a video controller, a system bus, a display monitor, a communication interface, and input devices. Further, the laptop 130 can comprise a digital controller, a microprocessor, or some other implementation of digital logic, for examples.

The laptop 130 executes software that may comprise an operating system and one or more software modules for managing data. The operating system can be the software product that Microsoft Corporation of Redmond, Wash. sells under the registered trademark WINDOWS, for example. The data management module can store, sort, and organize data and can also provide a capability for graphing, plotting, charting, or trending data. The data management module can be or comprise the software product that Microsoft Corporation sells under the registered trademark EXCEL, for example.

In one exemplary embodiment of the present invention, a multitasking computer functions as the laptop 130. Multiple programs can execute in an overlapping timeframe or in a manner that appears concurrent or simultaneous to a human observer. Multitasking operation can comprise time slicing or timesharing, for example.

The data management module can comprise one or more computer programs or pieces of computer executable code. To name a few examples, the data management module can comprise one or more of a utility, a module or object of code, a software program, an interactive program, a "plug-in," an "applet," a script, a "scriptlet," an operating system, a browser, an object handler, a standalone program, a language, a program that is not a standalone program, a program that runs a computer 130, a program that performs maintenance or general purpose chores, a program that is launched to enable a machine or human user to interact with data, a program that creates or is used to create another program, and a program that assists a user in the performance of a task such as database interaction, word processing, accounting, or file management.

Turning now to FIG. 2, this figure illustrates a functional block diagram of a system 200 for scanning tubing 125 that is being inserted into or extracted from an oil well 175 according to an exemplary embodiment of the present invention. Thus, the system 200 provides an exemplary embodiment of the instrumentation system shown in FIG. 1 and discussed above, and will be discussed as such.

Those skilled in the information-technology, computing, signal processing, sensor, or electronics arts will recognize that the components and functions that are illustrated as individual blocks in FIG. 2, and referenced as such elsewhere herein, are not necessarily well-defined modules. Furthermore, the contents of each block are not necessarily positioned in one physical location. In one embodiment of the present invention, certain blocks represent virtual modules, and the components, data, and functions may be physically dispersed. Moreover, in some exemplary embodiments, a single physical device may perform two or more functions that FIG. 2 illustrates in two or more distinct blocks. For example, the function of the personal computer 130 can be integrated into the tubing scanner 150 to provide a unitary hardware and software element that acquires and processes data and displays processed data in graphical form for viewing by an operator, technician, or engineer.

The tubing scanner 150 comprises a rod-wear sensor 205 and a pitting sensor 255 for determining parameters relevant to continued use of the tubing 125. The rod-wear sensor 205 assesses relatively large tubing defects or problems such as wall thinning. Wall thinning may be due to physical wear or abrasion between the tubing 125 and the sucker rod that is reciprocated against therein, for example. Meanwhile, the pitting sensor 255 detects or identifies smaller flaws, such as pitting stemming from corrosion or some other form of chemical attack within the well 175. Those small flaws may be visible to the naked eye or microscopic, for example.

The inclusion of the rod-wear sensor 205 and the pitting sensor 225 in the tubing scanner 150 is intended to be illustrative rather than limiting. The tubing scanner 150 can comprise another sensor or measuring apparatus that may be suited to a particular application, including ultrasonic sensors For example, the instrumentation system 200 can comprise a collar locator, a device that detects tubing cracks or splits, a temperature gauge, etc. In one exemplary embodiment of the present invention, scanner 150 comprises or is coupled to an inventory counter, such as the inventory counter discussed in U.S. Patent Application Publication Number 2004/0196032.

The tubing scanner 150 also comprises a controller 250 that processes signals from the rod-wear sensor 205 and the pitting sensor 255. The exemplary controller 250 has two filter modules 225, 275 that each, as discussed in further detail below, adaptively or flexibly processes sensor signals. In one exemplary embodiment, the controller 250 processes signals according to a speed measurement from the encoder 115.

The controller 250 can comprise a computer, a microprocessor 290, a computing device, or some other implementation of programmable or hardwired digital logic. In one exemplary embodiment, the controller 250 comprises one or more application specific integrated circuits ("ASICS") or DSP chips that perform the functions of the filters 225, 275, as discussed below. The filter modules 225, 275 can comprise executable code stored on ROM, programmable ROM ("PROM"), RAM, an optical format, a hard drive, magnetic media, tape, paper, or some other machine readable medium.

The rod-wear sensor 205 comprises a transducer 210 that, as discussed above, outputs an electrical signal containing information about the section of tubing 125 that is in the measurement zone 155. Sensor electronics 220 amplify or condition that output signal and feed the conditioned signal to the ADC 215. The ADC 215 converts the signal into a digital format, typically providing samples or snapshots of the thickness of the portion of the tubing 125 that is situated in the measurement zone 155.

The rod-wear filter module 225 receives the samples or snapshots from the ADC 215 and digitally processes those signals to facilitate machine- or human-based signal interpretation. The communication link 135 carries the digitally processed signals 230 from the rod-wear filter module 225 to the laptop 130 for recording and/or review by one or more members of the service crew. The service crew can observe the processed data to evaluate the tubing 125 for ongoing service.

Similar to the rod-wear sensor 205, the pitting sensor 255 comprises a pitting transducer 260, sensor electronics 270 that amplify the transducer's output, and an ADC 265 for digitizing and/or sampling the amplified signal from the sensor electronics 270. Like the rod-wear filter module 225, the pitting filter module 275 digitally processes measurement samples from the ADC 265 outputs a signal 280 that exhibits improved signal fidelity for display on the laptop 130.

Each of the transducers 210, 260 generates a stimulus and outputs a signal according to the tubing's 125 response to that stimulus. For example, one of the transducers 210, 260 may generate a magnetic field and detect the tubing's 125 effect or distortion of that field. In one exemplary embodiment, the pitting transducer 260 comprises field coils that generate the magnetic field and hall effect sensors or magnetic "pickup" coils that detect field strength.

In one exemplary embodiment, one of the transducers 210, 260 may output ionizing radiation, such as a gamma rays, incident upon the tubing 125. The tubing 125 blocks or deflects a fraction of the radiation and allows transmission of another portion of the radiation. In this example, one or both of the transducers 210, 260 comprises a detector that outputs an electrical signal with a strength or amplitude that changes according to the number of gamma rays detected. The detector may count individual gamma rays by outputting a discrete signal when a gamma ray interacts with the detector, for example.

Processes of exemplary embodiments of the present invention will now be discussed with reference to FIGS. 3-11. An exemplary embodiment of the present invention can comprise one or more computer programs or computer-implemented methods that implement functions or steps described herein and illustrated in the exemplary flowcharts, graphs, and data sets of FIGS. 3-11 and the diagrams of FIGS. 1 and 2. However, it should be apparent that there could be many different ways of implementing the invention in computer programming, and the invention should not be construed as limited to any one set of computer program instructions. Further, a skilled programmer would be able to write such a computer program to implement the disclosed invention without difficulty based on the exemplary system architectures, data tables, data plots, and flowcharts and the associated description in the application text, for example.

Therefore, disclosure of a particular set of program code instructions is not considered necessary for an adequate understanding of how to make and use the invention. The inventive functionality of any claimed process, method, or computer program will be explained in more detail in the following description in conjunction with the remaining figures illustrating representative functions and program flow.

Certain steps in the processes described below must naturally precede others for the present invention to function as described. However, the present invention is not limited to the order of the steps described if such order or sequence does not alter the functionality of the present invention in an undesirable manner. That is, it is recognized that some steps may be performed before or after other steps or in parallel with other steps without departing from the scope and spirit of the present invention.

Figure 3:
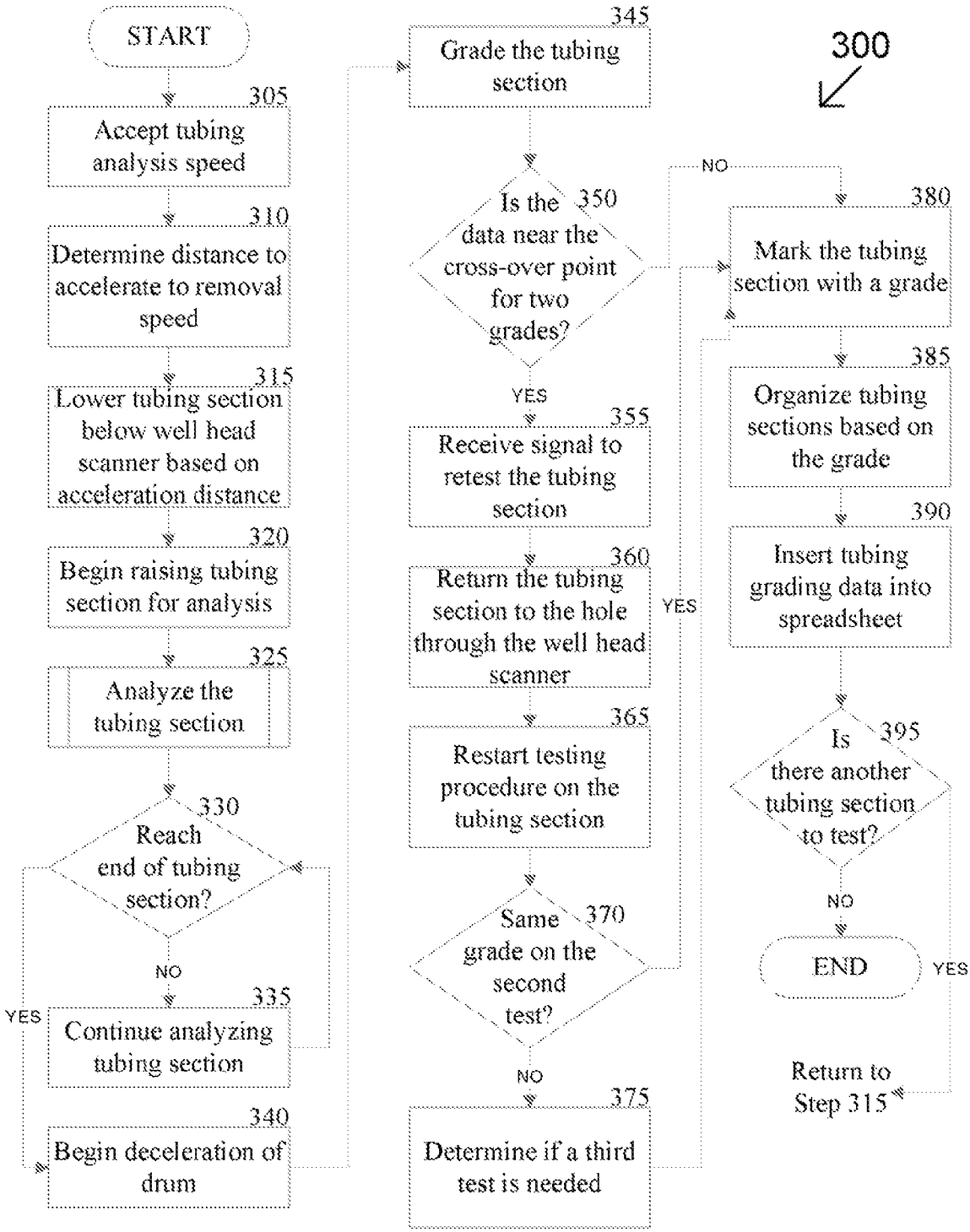
FIG. 3 is a flowchart of an exemplary process for obtaining information about tubing that is being inserted into or extracted from an oil well in accordance with one exemplary embodiment of the present invention.

Turning now to FIG. 3, an exemplary process 300 for obtaining information about tubing 125 that is being inserted into or extracted from an oil well 175 is shown and described within the operating environment of the exemplary workover rig 140 and tubing scanner 150 of FIGS. 1 and 2. Now referring to FIGS. 1, 2, and 3, the exemplary method 300 begins at the START step and proceeds to step 305, in which a tubing analysis speed is accepted. The tubing analysis speed can be input into the system at the computer 130 or the workover rig 140. The tubing analysis speed can be the same for all analysis jobs or differ depending on the type of pipe, the capabilities of the sensors being used, or the analysis conditions. In one exemplary embodiment, the tubing analysis speed is set by a dial indicator or keypad in the workover rig 140. In another exemplary embodiment, the tubing analysis speed is constant for all applications and a way to change the tubing analysis speed is not necessary. In one exemplary embodiment, the tubing analysis speed is between two and four linear feet per minute, however, those of ordinary skill in the art will recognize that speeds above and below this range can be used to analyze the tubing 125 and still achieve the objectives of the current invention.

In step 310, the tubing removal distance the workover rig 140 needs to accelerate to the analysis speed is determined. In one exemplary embodiment, the computer 130 is used to determine this distance. The beginning portion of the tubing section 125 to be analyzed is lowered below the tubing scanner 150 a distance greater than or equal to the distance the workover rig 140 needs to accelerate to the analysis speed in step 315. In one exemplary embodiment, the tubing section 125 is lowered so as to have a consistent speed within the analysis speed range for the entire section of tubing 125 that is being analyzed. However, in an alternative exemplary embodiment, the steps of determining the acceleration distance and lowering the tubing section 125 that distance can be skipped and a portion of the tubing section 125 can be analyzed at the analysis speed.

In step 320, the workover rig 140 begins raising the tubing section 125 for analysis by the tubing scanner 150. The tubing scanner 150 analyzes the tubing section 125 in step 325. In step 330, an inquiry is conducted to determine if the end of the tubing section 125 has been reached. The end of the tubing section 125 can be determined visually by the operator of the workover rig 140 or others on the job site. Additionally, sensors can be added to the tubing scanner 150 to detect each of the couplings and transfer that information to the computer 130, which can determine when the end of a particular tubing section 125 has been reached. In another exemplary embodiment, the end of a scanning cycle can be determined by analysis of the encoder 115 signal. When the encoder 115 signal shown that the drum 110 speed slows down, stops and then goes in reverse, the computer 130 can be programmed to consider that point to be the end of an analysis cycle. In yet another exemplary embodiment, the computer 130 can be programmed to evaluate the sensor and encoder data, to look for specific lengths of tubing 125, which could be programmed into the computer 130 at a prior point in time or while at the well site, and a particular number of couplings (not shown). For example, the computer 130 could be programmed to evaluate the data looking for a length of tubing section 125 that is sixty linear feet long and the passing of two couplings past the tubing scanner 150. Once the computer 130 has determined that the second coupling has passed and approximately sixty feet of tubing 125 has passed, the computer can consider that the end of a tubing section 125 has been reached. If the end of the tubing section 125 has not been reached, the "NO" branch is followed to step 335, where the tubing scanner 150 continues to analyze the tubing section 125. The process then returns to step 330. On the other hand, if the end of the tubing section 125 has been reached, the "YES" branch is followed to step 340.

In step 340, the workover rig 140 begins to decelerate the drum 110 that is lifting the tubing section 125 from the well 175. The tubing section 125 that was just analyzed is graded in step 345. The grading of the piping is typically conducted by reviewing the analysis data. In one exemplary embodiment, the tubing sections 125 can receive one of four grades established by the American Petroleum Institute: yellow, blue, green, and red as described in *Specification for Casing and Tubing: API Specification 5CT,* Third ed., Dec. 1, 1990, and *Recommended Practice for Field Inspection of New Casing, Tubing, and Plain-End Drill Pipe: API Recommended Practice 5A5*, Fourth ed., May 1, 1989, each of which are hereby incorporated by reference. A tubing section 125 typically receives a grade of "yellow" when the body loss is less than sixteen percent. A tubing section 125 typically receives a grade of "blue" when the body loss is less than thirty-one percent but greater than or equal to sixteen percent. A tubing section 125 typically receives a grade of "green" when the body loss is less than fifty-one percent but greater than or equal to thirty-one percent. A tubing section 125 typically receives a grade of "red" when the body loss is greater than fifty-one percent.

In step 350, an inquiry is conducted to determine if the data used in grading the tubing section 125 is at or near the threshold of two grades. This determination can be made by the computer 130 or an operator of the workover rig 140. In one exemplary embodiment, data showing that the tubing grade is close to either blue or green is of the greatest priority because many of those in the industry will reuse a pipe having a grade of blue, but will dispose of a pipe if it receives a grade of green. A determination of whether the data is near the threshold of a grade can be based on a predetermined level that can be given to the operator or programmed into the computer 130. If the analysis data is not near the threshold for two grades, the "NO" branch is followed to step 380. Otherwise, the "YES" branch is followed to step 355, where a signal is received to retest the tubing section 125. The signal can include an audio or visual signal capable of being received at the computer 130 or the workover rig 140. In another exemplary embodiment, the signal could be the operator of the workover rig 140 informing others that the tubing section 125 needs to be retested through the use of voice or hand signals.

The tubing section 125 is lowered back into the well 175 through the tubing scanner 150 in step 360. In step 365, testing to obtain analysis data for the tubing section 125 is completed in the same manner as the original test. In step 370, an inquiry is conducted to determine if the tubing section 125 received the same grade on the second test as it did on the first test. If the tubing section 125 did not receive the same grade, the "NO" branch is followed to step 375, where a determination is made whether to conduct a third test on the tubing section 125. This determination can be made by the workover rig 140 operator or can be programmed into the computer 130. If a third test is conducted, the process would return to step 365. Otherwise the process continues to step 380. Returning to step 370, if the tubing section 125 received the same grade on the second test, the "YES" branch is followed to step 380, where the tubing section 125 is marked with a grade. In one exemplary embodiment, the tubing section 125 is marked with the grade by applying spray paint having the same color as the grade to a portion of the exterior of the tubing section 125. In another exemplary embodiment, once the computer 130 determines a grade for the tubing section 125, colors or text are automatically applied to the tubing section 125 by a marking apparatus positioned atop the tubing scanner 150.

In step 385, the tubing sections 125 are organized by grade. The pipe grading data in inserted into a spreadsheet in step 390. The grading data can be manually entered by an operator or automatically downloaded from the scanning data and inserted into the spreadsheet at the computer 130. In one exemplary embodiment the grading data is inserted into a log presentation or chart based on the depth that the particular piece of tubing 125 was located during the operation of the well 175. In step 395, an inquiry is conducted to determine if there is another tubing section 125 to test. If so, the "YES" branch is followed to step 315. Otherwise, the "NO" branch is followed to the END step.

Figure 4:
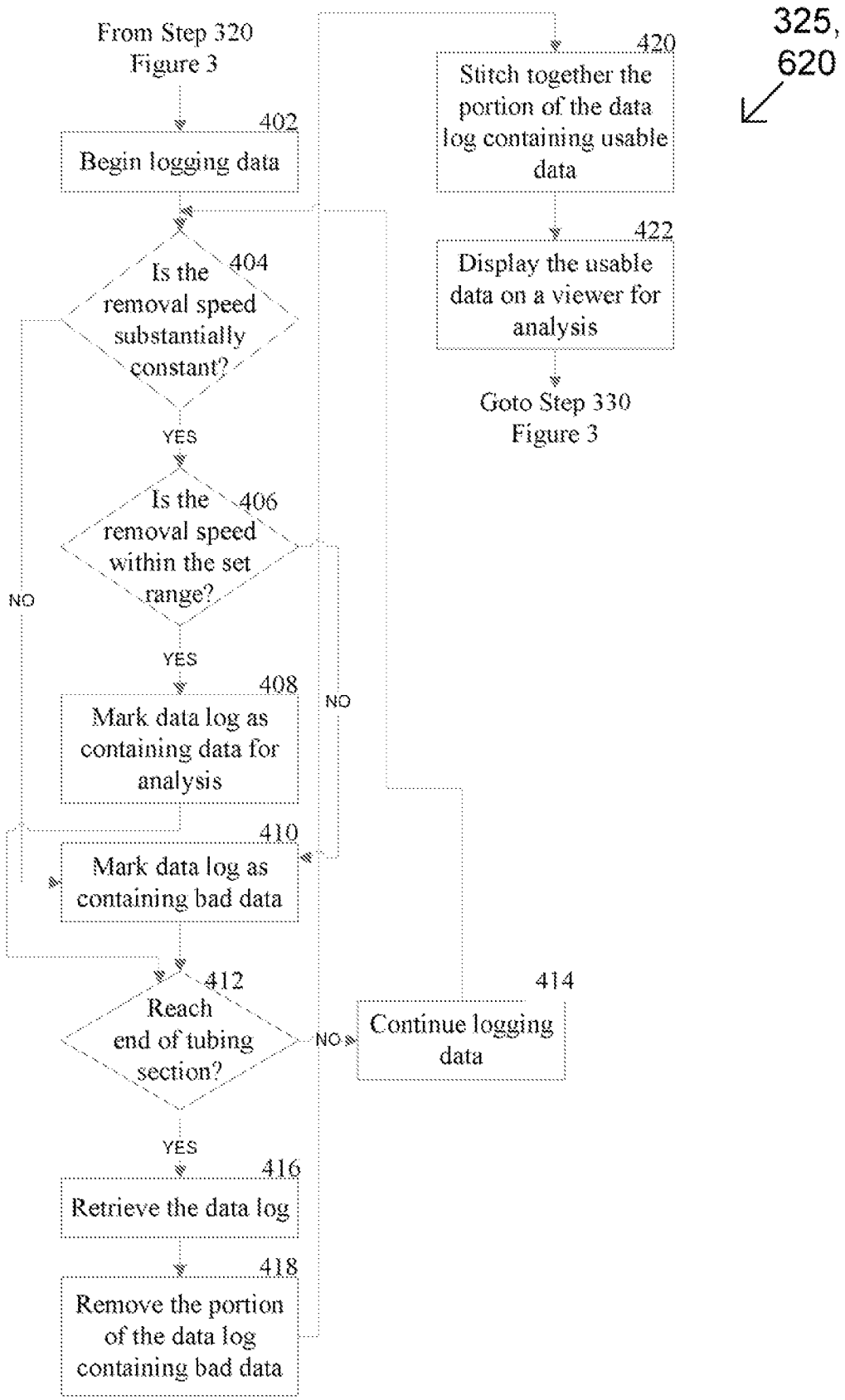
FIG. 4 is a flowchart of an exemplary process for analyzing a segment of tubing to determine the grade of the tubing in accordance with one exemplary embodiment of the present invention.
Figure 6:
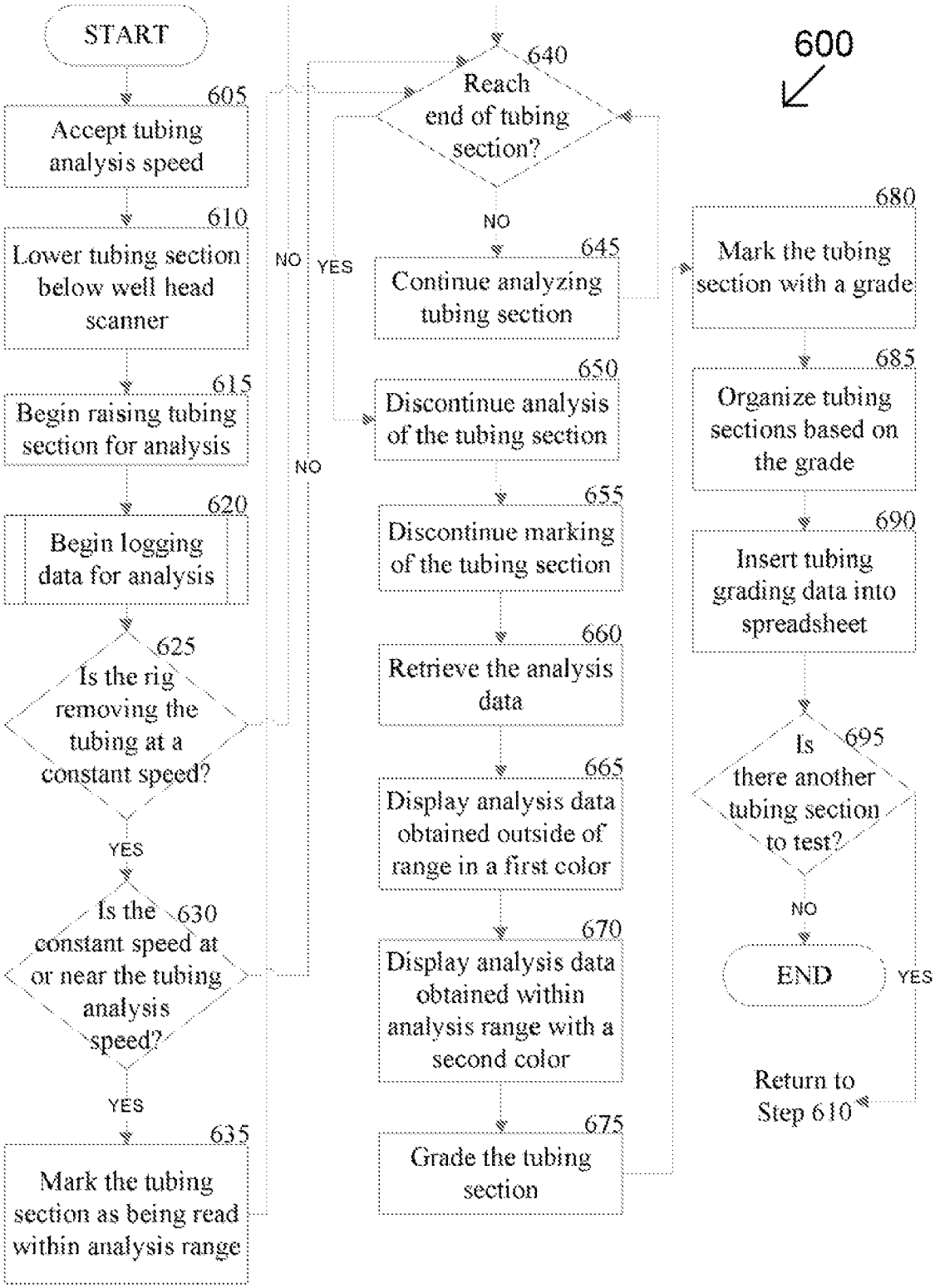
FIG. 6 is a flowchart of another exemplary process for obtaining information about tubing that is being inserted into or extracted from an oil well in accordance with one exemplary embodiment of the present invention.

FIG. 4 is a logical flowchart diagram illustrating an exemplary method for analyzing a section of tubing 125 to determine the grade of the tubing 125 as completed by step 325 of FIG. 3 and 620 of FIG. 6. Referencing FIGS. 1, 2, 3, and 4, the exemplary method 325, 620 begins with the computer 130 logging data it receives from the sensors in the tubing scanner 150 in step 402. In step 404, an inquiry is conducted to determine if the removal speed of the tubing section 125 is substantially constant. The tubing speed can be determined by evaluating a signal sent from the encoder 115 along the drum 110 to the computer 130. In one exemplary embodiment, the computer 130 is programmed with the allowable tolerances for the tubing speed in order to determine if the speed range is considered substantially constant. If the tubing speed is not substantially constant, the "NO" branch is followed to step 410. Otherwise, the "YES" branch is followed to step 406.

In step 406, an inquiry is made by the computer 130 to determine if the removal speed is within the set range. In one exemplary embodiment, the optimum removal speed is between two and four feet per minute, however other speeds above and below that range may be used, and analysis speeds may be dependent on the type of tubing 125 being removed and the capabilities of the sensors used to analyze the tubing 125. If the removal speed is within the set range, the "YES" branch is followed to step 408, where the analysis data being retrieved is "marked" as containing data for analysis. The process then continues to step 412. On the other hand, if the removal speed is not within the set range, the "NO" branch is followed to step 410, where the analysis data is "marked" as containing bad data. In one exemplary embodiment, the analysis data is displayed on a viewable screen of the computer 130, in which, the bad data is marked out by placing "X"s though the portion of the graph containing the bad data. In another exemplary embodiment, the displayed data can be disseminated by color. For example, the bad data on the graph could be highlighted in red, while the good data could be highlighted in green. In a further exemplary embodiment, the analysis data could be displayed such that the bad data is not displayed on the analysis graph.

In step 412, an inquiry is conducted to determine if the tubing scanner 150 has reached the end of the tubing section 125. Sensors could be attached to the computer 130 at the tubing scanner 150 to sense for couplings in order to determine if the end of a tubing section 125 is reached. If the end of a tubing section 125 has not been reached, the "NO" branch is followed to step 414, where the computer 130 continues to log and analyze the analysis data. The process then returns to step 404. On the other hand, if a tubing section 125 has been reached, the "YES" branch is followed to step 416, where the computer 130 retrieves the data log. In step 418, the computer 130 removes the portion of the data log containing bad data from the entirety of the charted data for the tubing section 125. The computer 130 stitches together the remaining "good" analysis data into a substantially single line of data for each tubing section 125 in step 420. In step 422, the computer 130 displays the "good data" on a monitor or viewer for analysis and grading of the tubing section 125. The process then returns to step 330 of FIG. 3.

Figure 9:
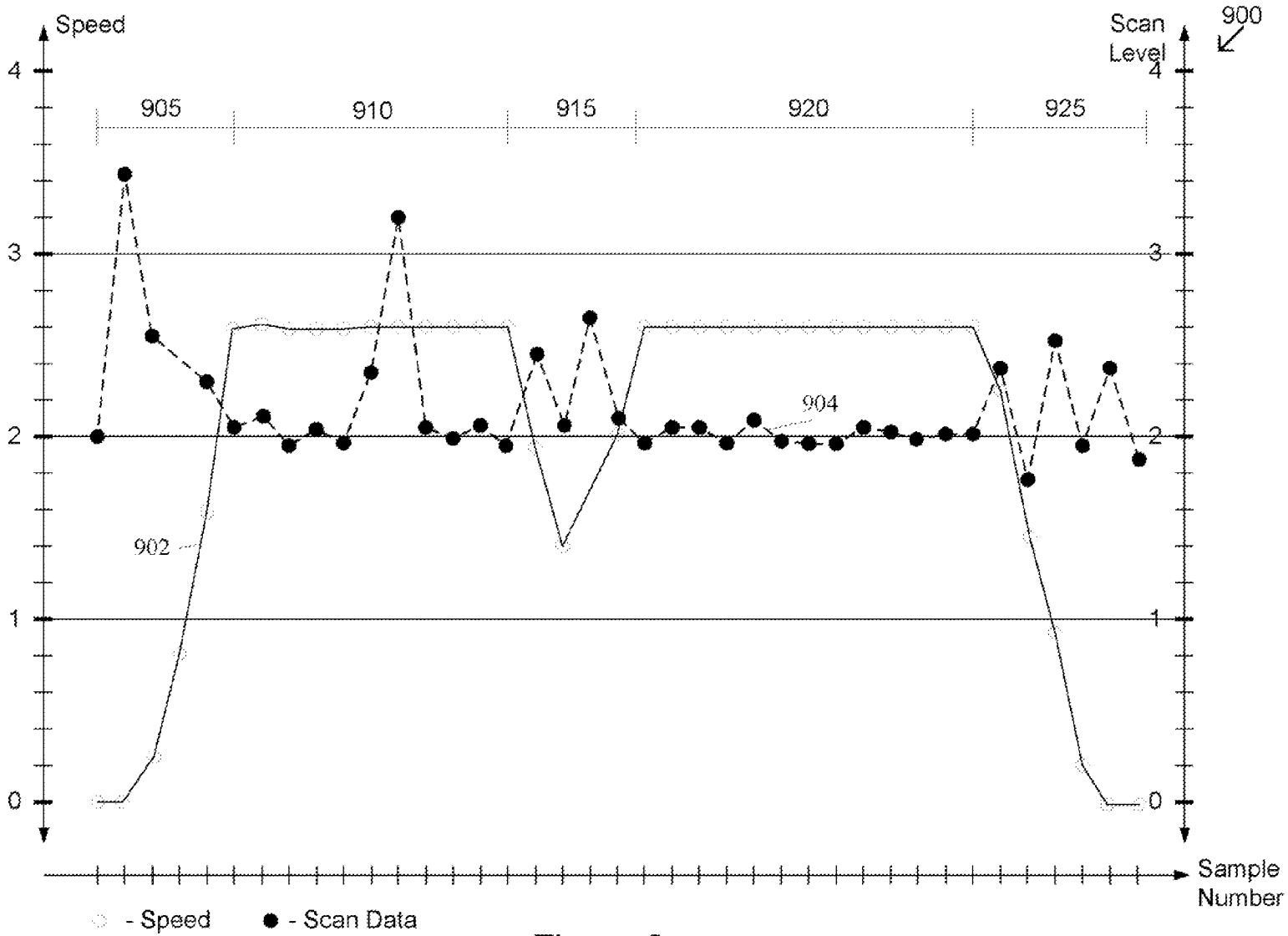
FIG. 9 is an exemplary chart comparing speed of the tubing section and analysis data from the tubing section in accordance with an exemplary embodiment of the present invention.
Figure 10A:
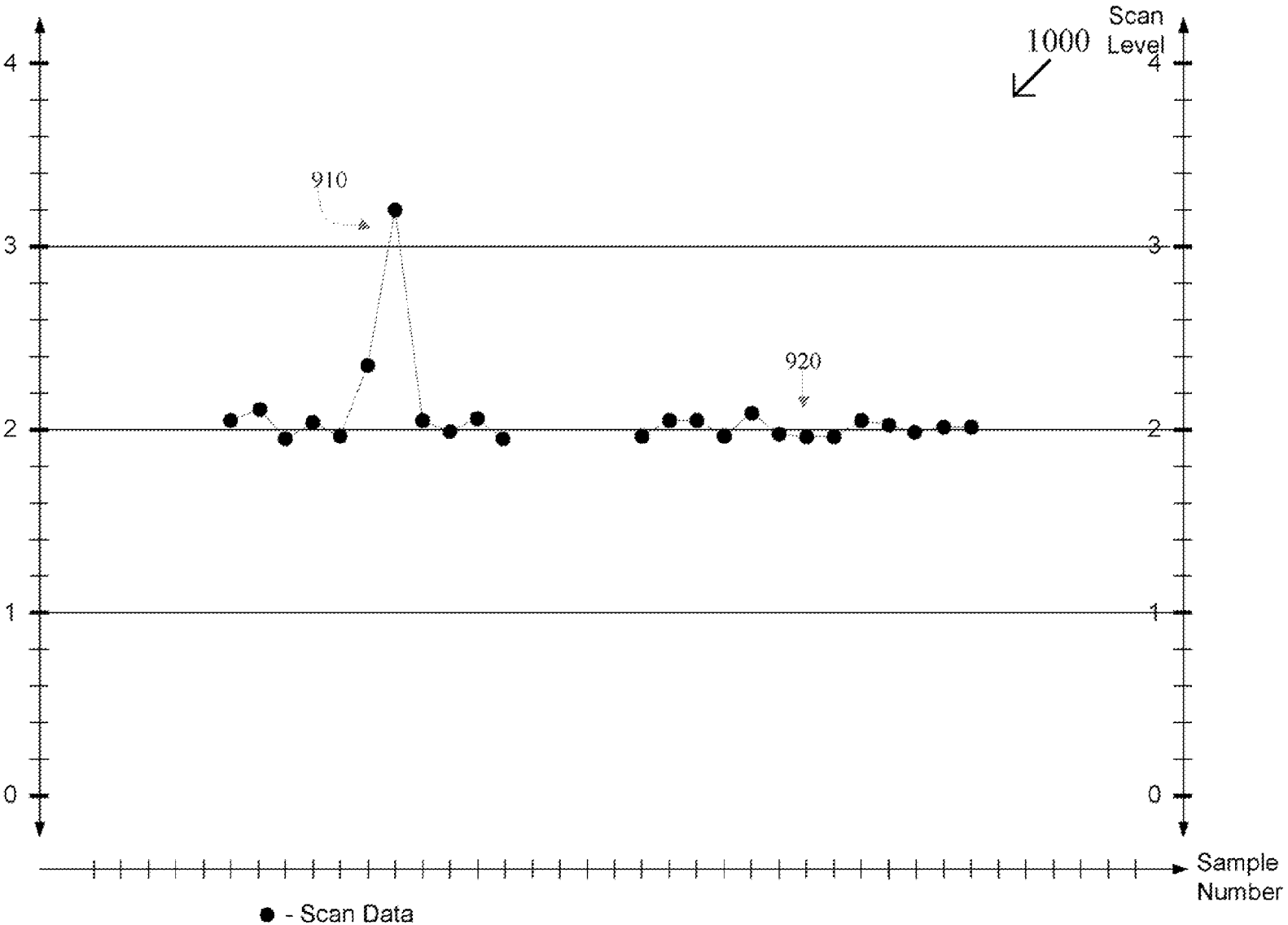
FIG. 10A is an exemplary chart displaying the analysis data from the tubing section after removing data obtained when the speed of the tubing section was out of range in accordance with one exemplary embodiment of the present invention.
Figure 10B:
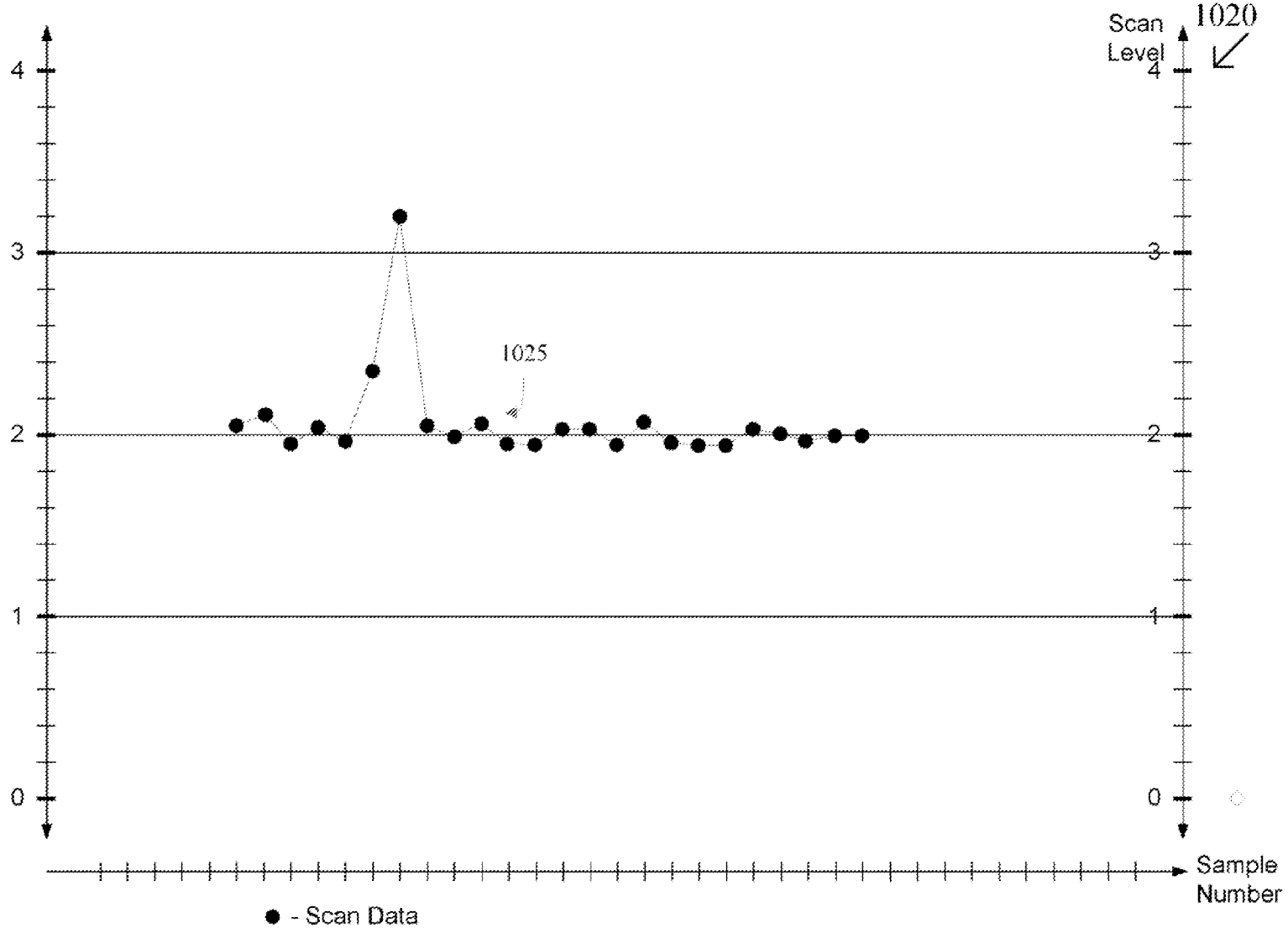
FIG. 10B is an exemplary chart displaying the analysis data combined into a single data string in accordance with one exemplary embodiment of the present invention.

FIGS. 9, 10A, and 10B, provide an exemplary view of steps 416-420 of FIG. 4. Now referring to FIG. 9, the exemplary data analysis display 900 includes speed data 902 and scan or analysis data 904. The data for each has been divided into five sections, shown above the data. Section 905 would be considered bad data because the removal speed is neither constant nor within the set range of 2.6 feet per minute. Section 910 would be considered good data, because the removal speed for the tubing section 125 is constant and at 2.6 feel per minute. It should be noted that the speed in section 910 is not exactly the same and the term constant is not meant to be synonymous with exactly the same. At least some minor fluctuation in removal or insertion speed of the tubing 125 is allowable and the range can be programmed into the computer 130. Section 915 would be considered bad data because the removal speed is not constant and it does not fall within the set speed range. Section 920 would be considered good data because the speed is relatively constant and the speed is within the set range. Finally, section 925 would be considered bad data because the speed is not constant and the speed is not within the set range. Section 905 exemplifies the workover rig 140 beginning to remove a tubing section 125 from a well 175, while section 925 exemplifies reaching the end of a tubing section 125 and slowing down the drum 110 of the workover rig 140.

Referring now to FIG. 10A, another exemplary view 1000 of the scan or analysis data is shown. Because a determination has been made as to what is "good" and "bad" data, the speed data has been removed from the display. In addition, the bad segments of analysis data have been removed from the display by the computer 130. Thus, analysis data from sections 905, 915, and 925 have been removed and the analysis data from sections 910 and 920 remain. Now referring to FIG. 10B, a display describing step 420 of FIG. 4 is shown. In the display 1020, the analysis data from section 910 and 920 have been "stitched" together to make one continuous line of data 1025. By removing the bad data and stitching the good data together, the tubing section 125 may be more easily, and thus, more consistently graded by the computer 130 or the operator of the workover rig 140.

Figure 5:
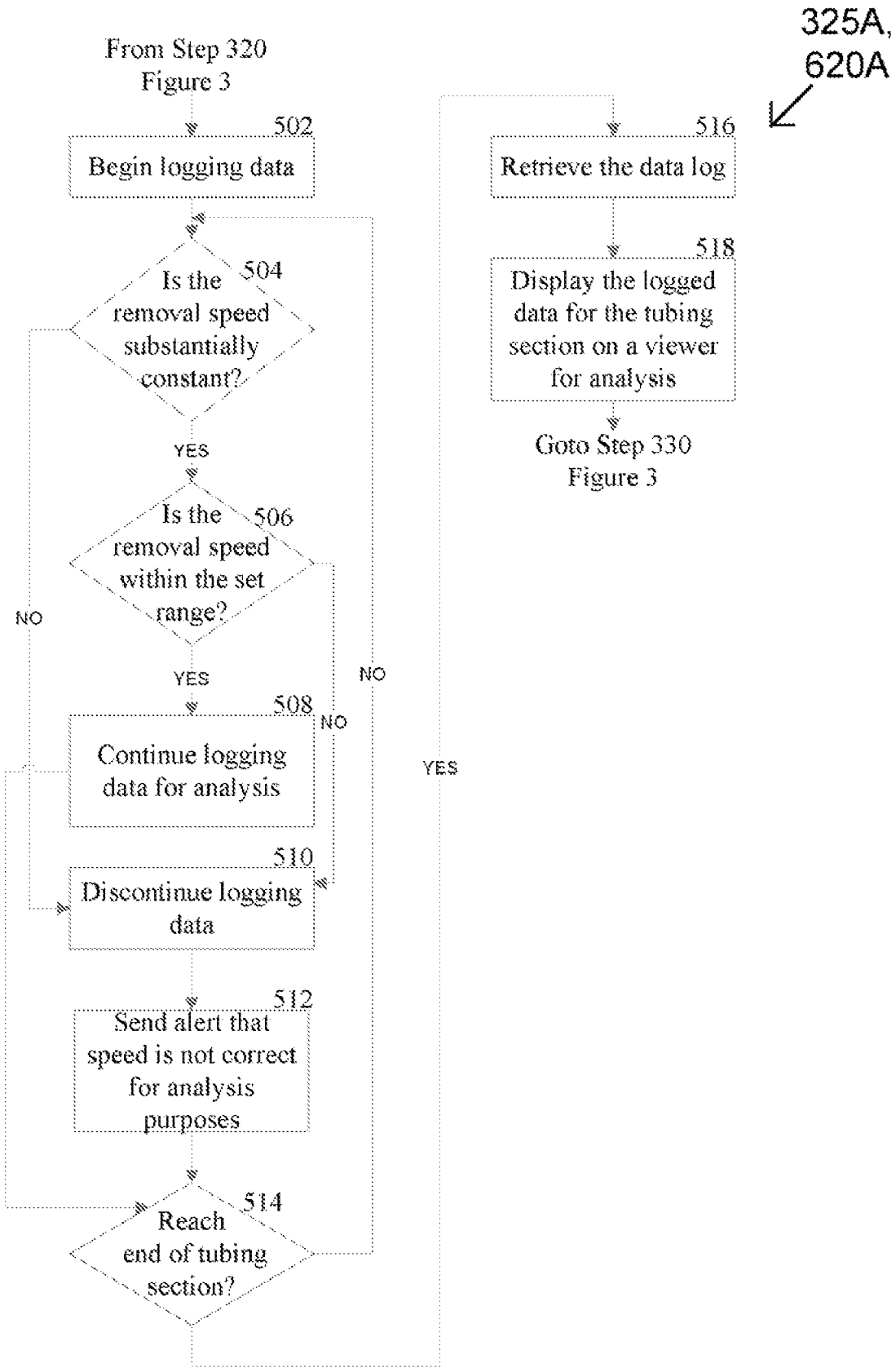
FIG. 5 is a flowchart of another exemplary process for analyzing a segment of tubing to determine the grade of the tubing in accordance with one exemplary embodiment of the present invention.

FIG. 5 is a logical flowchart diagram illustrating another exemplary method for analyzing and displaying a section of tubing analysis data to determine the grade of the tubing section 125 as completed by step 325 of FIG. 3 and step 620 of FIG. 6. Referencing FIGS. 1, 2, 3, and 5, the exemplary method 325A, 620A begins with the computer 130 logging data it receives from the sensors in the tubing scanner 150 in step 502. In step 504, an inquiry is conducted to determine if the removal speed of the tubing section 125 is substantially constant. The tubing speed can be determined by evaluating a signal sent from the encoder 115 along the drum 110 to the computer 130. In one exemplary embodiment, the computer 130 is programmed with the allowable tolerances for the tubing speed in order to determine if the speed range is considered substantially constant. If the tubing speed is not substantially constant, the "NO" branch is followed to step 510. Otherwise, the "YES" branch is followed to step 506.

In step 506, an inquiry is made by the computer 130 to determine if the removal speed is within the set range. In one exemplary embodiment, the optimum removal speed is between two and four feet per minute, however other speeds above or below that range may be used, and the speeds may be selected based upon the type of tubing 125 being removed and the capabilities of the sensors used to analyze the tubing 125. If the removal speed is within the set range, the "YES" branch is followed to step 508, where the computer 130 continues logging the received data for analysis. The process then continues to step 514. On the other hand, if the removal speed is not within the set range, the "NO" branch is followed to step 510, where the computer 130 stops plotting the received analysis data until the data received satisfies the speed and consistency requirements. An alert is received that the speed is not correct for analysis purposes in step 512. In one exemplary embodiment this alert is a visual or audible signal at the computer 130 and capable of also being viewed by the operator of the workover rig 140, however, other methods of signaling known to those of skill in the art could be used.

In step 514, an inquiry is conducted to determine if the tubing scanner 150 has reached the end of the tubing section 125. Sensors could be attached to the computer 130 at the tubing scanner 150 to sense for couplings in order to determine if the end of a tubing section 125 is reached. If the end of a tubing section 125 has not been reached, the "NO" branch is followed to step 504, where the computer 130 continues to log and analyze the logged data. On the other hand, if the end of a tubing section 125 has been reached, the "YES" branch is followed to step 516, where the computer 130 retrieves the data log. In step 518, the computer 130 displays the logged data for the tubing section 125 on a monitor or viewer for analysis and grading of the tubing section 125. The process then returns to step 330 of FIG. 3. The method disclosed in FIG. 5 eliminates the need to removed the bad data from the good data and stitch the remaining portions of good data together because, in effect, only the good data is being plotted by the computer 130.

FIG. 6 is a logical flowchart diagram illustrating the steps for an exemplary method 600 for obtaining information about tubing sections 125 that are being inserted or extracted from an oil well 175 within the operating environment of the exemplary workover rig 140 of FIG. 1. Now referring to FIGS. 1, 2, and 6, the exemplary method 600 begins at the START step and proceeds to step 605, in which a tubing analysis speed is accepted. In one exemplary embodiment, the tubing analysis speed can be input into the system at the computer 130 or the workover rig 140. The tubing analysis speed is typically between two and four linear feet per minute, however, those of ordinary skill in the art will recognize that speeds above and below this range can be used to analyze the tubing 125 and the analysis speed can be dependant upon the type of tubing 125 and the capabilities of the sensors and analysis techniques being used.

The beginning portion of the tubing section 125 to be analyzed is lowered below the tubing scanner 150 in step 610. In one exemplary embodiment, the tubing section 125 is lowered so as to have a consistent speed within the analysis speed range for a majority of the tubing section 125 that is being analyzed. In step 615, the workover rig 140 begins raising the tubing section 125 for analysis by the tubing scanner 150. The tubing scanner 150 analyzes the tubing section 125 in step 620.

In step 625, an inquiry is conducted to determine if the drum 110 removing the tubing section 125 is at a substantially constant speed. If so, the "YES" branch is followed to step 630. Otherwise, the "NO" branch is followed to step 640. In step 630, an inquiry is conducted to determine if the constant speed is at or near the tubing analysis speed. If not, the "NO" branch is followed to step 640. On the other hand, if the speed is at or substantially near the analysis speed, the "YES" branch is followed to step 635, where the tubing scanner 150 marks the tubing section 125 as being read within the analysis range. In one exemplary embodiment, the tubing section 125 is marked with a visible color along the exterior of the tubing section 125 to allow the operator to know which portions of the tubing section 125 received analysis at the designated speed. In this exemplary embodiment a spraying system can be positioned near the top of the tubing scanner 150.

In step 640, an inquiry is conducted to determine if the end of the tubing section 125 has been reached. The end of the tubing section 125 can be determined visually by the operator of the workover rig 140 or others on the job site. In another exemplary embodiment, sensors can be added to the tubing scanner 150 to detect each of the couplings that hold together sections of tubing 125 and transfer that information to the computer 130, which can determine when the end of a particular tubing section 125 has been reached. If the end of the tubing section 125 has not been reached, the "NO" branch is followed to step 645, where the tubing scanner 150 continues to analyze the tubing section 125. The process then returns to step 640. On the other hand, if the end of the tubing section 125 has been reached, the "YES" branch is followed to step 650.

In step 650, the tubing scanner 150 stops analyzing the tubing section 125. The tubing scanner 150 stops marking the tubing section 125 in step 655. The analysis data is retrieved in step 660. In step 665, the computer 130 displays the analysis data that was obtained outside of the analysis speed range in a first color. In one exemplary embodiment, data obtained outside the analysis speed range is highlighted or displayed in red. The computer 130 displays the analysis data obtained within the analysis speed range and at a substantially constant speed in a second color. In one exemplary embodiment, data that was obtained within the required parameters is highlighted or displayed in green. The tubing section 125 that was just analyzed and displayed is graded in step 675 by reviewing the color-coded analysis data. The tubing section 125 is marked with a grade in step 680. In one exemplary embodiment, the tubing section 125 can be marked with a color or text to denote the grade received. In another exemplary embodiment, once the computer 130 determines a grade for the tubing section 125, colors or text are automatically applied to the tubing section 125 by a marking apparatus positioned atop the tubing scanner 150.

In step 685, the tubing sections 125 are organized by grade. The tube grading data is inserted into a spreadsheet in step 690. The grading data can be manually entered by an operator or automatically downloaded from the scanning data and inserted into the spreadsheet at the computer 130. In step 695, an inquiry is conducted to determine if there is another tubing section 125 to test. If so, the "YES" branch is followed to step 610. Otherwise, the "MO" branch is followed to the END step.

Figure 7:
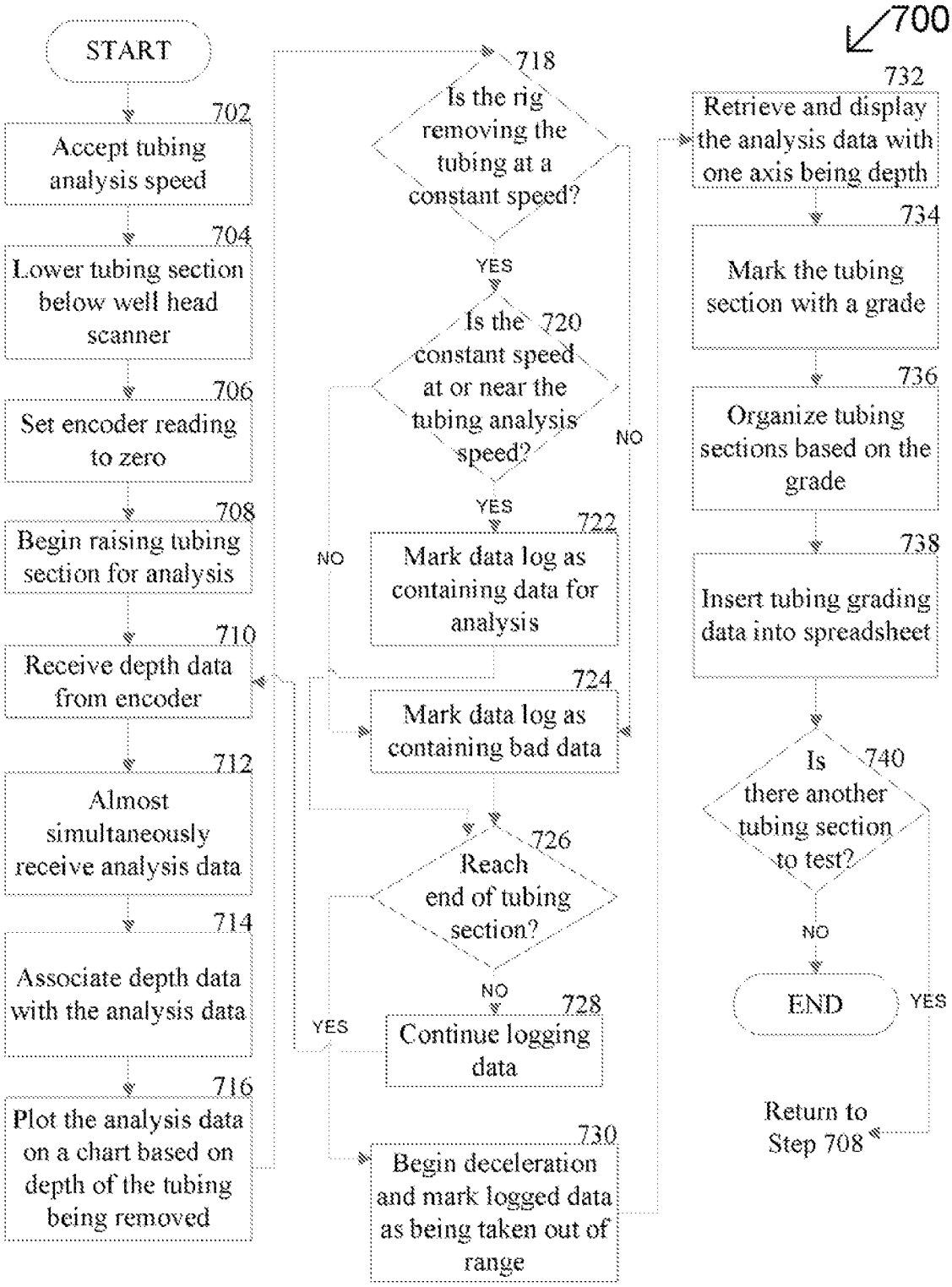
FIG. 7 is another exemplary process for obtaining information about tubing that is being inserted into or extracted from an oil well in accordance with one exemplary embodiment of the present invention.

FIG. 7 is a logical flowchart diagram illustrating the steps for an exemplary method 700 for obtaining information about tubing sections 125 that are being inserted or extracted from an oil well 175 and plotting that information according to the depth or length of the tubing sections 125 within the operating environment of the exemplary workover rig 140 of FIG. 1. Now referring to FIGS. 1, 2, and 7, the exemplary method 700 begins at the START step and proceeds to step 702, in which a tubing analysis speed is accepted. In one exemplary embodiment, the tubing analysis speed can be input into the system at the computer 130 or the workover rig 140.

The beginning portion of the tubing section 125 to be analyzed is lowered below the tubing scanner 150 in step 704. In one exemplary embodiment, the tubing section 125 is lowered just below the sensors of the tubing scanner 150 so that a zero-depth point can be set at the encoder 115 or computer 130. In step 706, the encoder reading is set to zero. The encoder reading is typically displayed at the computer 130 or in the cab 140 of the workover rig 140. In one exemplary embodiment the encoder reading is set to zero before the first tubing section 125 is removed from the well 175. In another exemplary embodiment, the encoder reading 115 can be set to zero for each tubing section 125 prior to removing that particular tubing section 125 from the well 175.

In step 708, the drum 110 of the workover rig 140 begins to remove the tubing section 125 from the well 175. The computer 130 receives depth or linear distance data from the encoder 115 in step 710. The computer 130 also receives analysis data from the sensors of the tubing scanner 150 at or near the same time that the depth data is received from the encoder 115 in step 712. In step 714, the computer 130 associates the depth data with the analysis data. The computer 130 generates a chart and plots the analysis data against the depth position of the tubing section 125 being removed in step 716.

In step 718, an inquiry is conducted to determine if the drum 110 is removing the tubing section 125 at a substantially constant speed. If so, the "YES" branch is followed to step 720. Otherwise, the "NO" branch is followed to step 724. In step 720, an inquiry is conducted to determine if the constant speed is at or near the tubing analysis speed. If not, the "NO" branch is followed to step 724. On the other hand, if the speed is at or substantially near the analysis speed, the "YES" branch is followed to step 722, where the computer 130 marks the analyzed data as being "good" data because it was read within the substantially constant pre-set tubing analysis speed. The process then continues to step 726.

Returning to step 724, if the removal was not at a constant speed or the speed was not within the required range, the computer 130 marks the logged data as containing "bad" data. In one exemplary embodiment, the computer 130 may insert symbols to designate the "good" analysis data from the "bad" analysis data. In another exemplary embodiment, the computer 130 may highlight or display the "good" data in one color and highlight or display the "bad" data in another color. In a further embodiment, the computer 130 may only display the "good" data.

In step 726, an inquiry is conducted to determine if the end of the tubing section 125 has been reached. The end of the tubing section 125 can be determined visually by the operator of the workover rig 140 or others on the job site. In another exemplary embodiment, sensors can be added to the tubing scanner 150 to detect each of the couplings that hold together sections of tubing 125 and transfer that information to the computer 130, which can determine when the end of a particular tubing section 125 has been reached. If the end of the tubing section 125 has not been reached, the "NO" branch is followed to step 728, where the tubing scanner 150 continues to analyze the tubing section 125. The process then returns to step 710. On the other hand, if the end of the tubing section 125 has been reached, the "YES" branch is followed to step 730.

In step 730, the drum 110 begins decelerating and the removal speed for the tubing section 125 slows. The computer 130 begins marking or designating the analysis data as "bad" data because the speed is out or the required range. The analysis data is retrieved and displayed with one axis being the depth of the tubing section 125 or length of the tubing section 125 in step 732. The computer 130 could display the retrieved analysis data in different colors, based on "good" and "bad" data, or display only the "good" data or follow the technique discussed in FIG. 3 and shown in FIGS. 9, 10A, and 10B. The tubing section 125 is marked with a grade in step 734. In one exemplary embodiment, the tubing section 125 can be marked with a color or text to denote the grade received. In another exemplary embodiment, once the computer 130 determines a grade for the tubing section 125, colors or text are automatically applied to the tubing section 125 by a marking apparatus positioned atop the tubing scanner 150.

In step 736, the tubing sections 125 are organized by grade. The tube grading data is inserted into a spreadsheet in step 738. The grading data can be manually entered by an operator or automatically downloaded from the scanning data and inserted into the spreadsheet at the computer 130. In step 740, an inquiry is conducted to determine if there is another tubing section 125 to test. If so, the "YES" branch is followed to step 708. Otherwise, the "NO" branch is followed to the END step.

Figure 8:
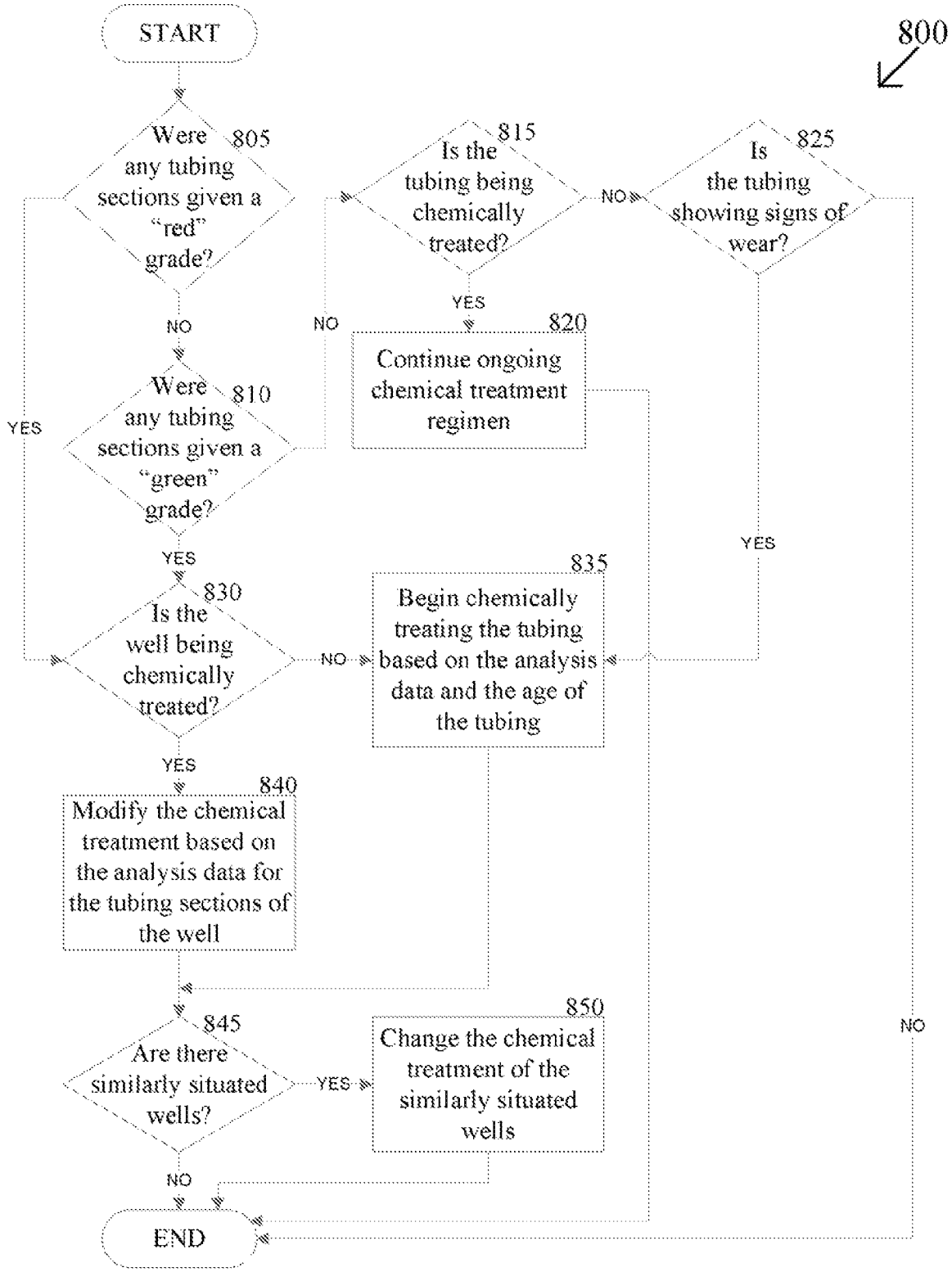
FIG. 8 is a flowchart of an exemplary process for determining a chemical treatment for a well based on analysis data of tubing sections from the well in accordance with one exemplary embodiment of the present invention.

FIG. 8 is a logical flowchart diagram presented to illustrate a process 800 for modifying the chemical treatment of wells 175 based on tubing analysis within the exemplary operating environment of the workover rig 140 and tubing scanner 150 of FIGS. 1 and 2. Now referring to FIGS. 1, 2, and 8, the exemplary method 800 begins at the START step and proceeds to step 805, where an inquiry is conducted to determine if any of the tubing sections 125 were given a grade of "red." If so, the "YES" branch is followed to step 830. On the other hand, if none of the tubing sections 125 received a "red" grade, the "NO" branch is followed to step 810.

In step 810, an inquiry is conducted to determine if any of the tubing sections 125 were given a grade of "green." If so, the "YES" branch is followed to step 830. Otherwise, the "NO" branch is followed to step 815. In step 815, an inquiry is conducted to determine if the well 175, from which the tubing sections 125 were removed, is currently being chemically treated. If the well 175 is being chemically treated, the "YES" branch is followed to step 820, where the current chemical treatment is continued for that well 175. The process continues to the END step. Returning to step 815, if the well 175 is not currently being chemically treated, the "NO" branch is followed to step 825.

In step 825, an inquiry is conducted to determine if the tubing sections 125 in the well 175 are showing signs of excessive wear. If so, the "YES" branch is followed to step 835. Otherwise, the "NO" branch is followed to the END step. Returning to step 830, if some of the tubing sections 125 from the well 175 have received a grade of "red" or "green," an inquiry is conducted to determine if the well 175 is being chemically treated. If the well 175 is not being chemically treated, the "NO" branch is followed to step 835, where a chemical treatment regimen is applied to the well 175 based on the analysis data for and the age of the tubing sections 125. Otherwise, the "YES" branch is followed to step 840, where the current chemical treatment regimen is modified based on the analysis data. The treatment regimen may be modified by changing the types of chemicals used, by adding additional chemicals, or by treating the well 175 more or less frequently.

In step 845, an inquiry is conducted to determine if there are any similarly situated wells 175. A well 175 may be similarly situated if it was drilled at approximately the same time as the well 175 that was analyzed, if it is in the vicinity of the well 175 that was analyzed, or for other reasons known to those of ordinary skill in the art of oil well drilling and maintenance. If there are similarly situated wells 175, the "YES" branch is followed to step 850, where the chemical treatment regimens for the similarly situated wells 175 is changed to closely match the changes to the analyzed well 175. The process then continues to the END step. If there are no similarly situated wells 175, then the "NO" branch is followed to the END step.

Figure 11:
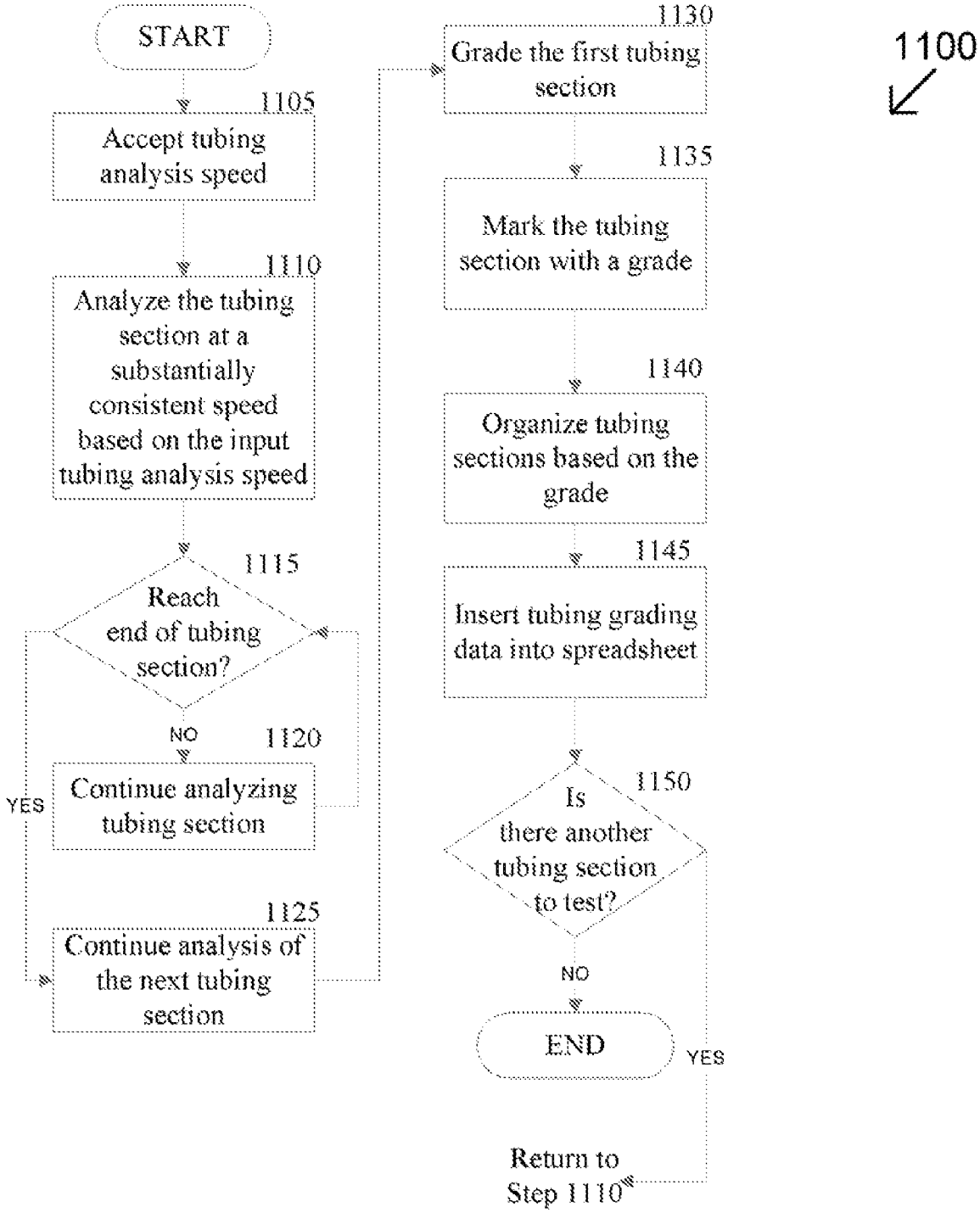
FIG. 11 is a flowchart of another exemplary process for obtaining information about tubing that is being inserted into or extracted from an oil well in accordance with one exemplary embodiment of the present invention.

FIG. 11 is yet another exemplary logical flowchart diagram presented to illustrate a process 1100 for obtaining information about tubing 125 that is being inserted into or extracted from an oil well at a substantially consistent speed within the exemplary operating environment of the workover rig 140 and tubing scanner 150 of FIGS. 1 and 2. Now referring to FIGS. 1, 2, and 11, the exemplary method 1100 begins at the START step and proceeds to step 1105, in which a tubing analysis speed is accepted. In step 1110, the workover rig 140 begins raising the tubing section 125 at a substantially consistent analysis speed and analyzes the tubing section 125 similar to the methods discussed in FIGS. 3-6.

In step 1115, an inquiry is conducted to determine if the end of the tubing section 125 has been reached. The end of the segment 125 can be determined visually by the operator of the workover rig 140 or others on the job site. Additionally, sensors can be added to the tubing scanner 150 to detect each of the couplings and transfer that information to the computer 130, which can determine when the end of a particular tubing section 125 has been reached. If the end of the tubing section 125 has not been reached, the "NO" branch is followed to step 1120, where the tubing scanner 150 continues to analyze the tubing section 125. The process then returns to step 1115. On the other hand, if the end of the tubing section 125 has been reached, the "YES" branch is followed to step 1125, where the tubing scanner 150 begins analysis of the next tubing section 125 while the first tubing section 125 is removed from the stand of well tubing.

The tubing section 125 that was just analyzed is graded in step 1130. The grading of the piping is typically conducted by reviewing the analysis data. In step 1135, the tubing section 125 is marked with the grade given based on a review of the analysis data by the computer 130 or by an operator. In step 1140, the tubing sections 125 are organized by grade. The pipe grading data in inserted into a spreadsheet in step 1145. The grading data can be manually entered by an operator or automatically downloaded from the scanning data and inserted into the spreadsheet at the computer 130. In step 1150, an inquiry is conducted to determine if there is another tubing section 125 to test. If so, the "YES" branch is followed to step 1110. Otherwise, the "NO" branch is followed to the END step.

Figure 12:
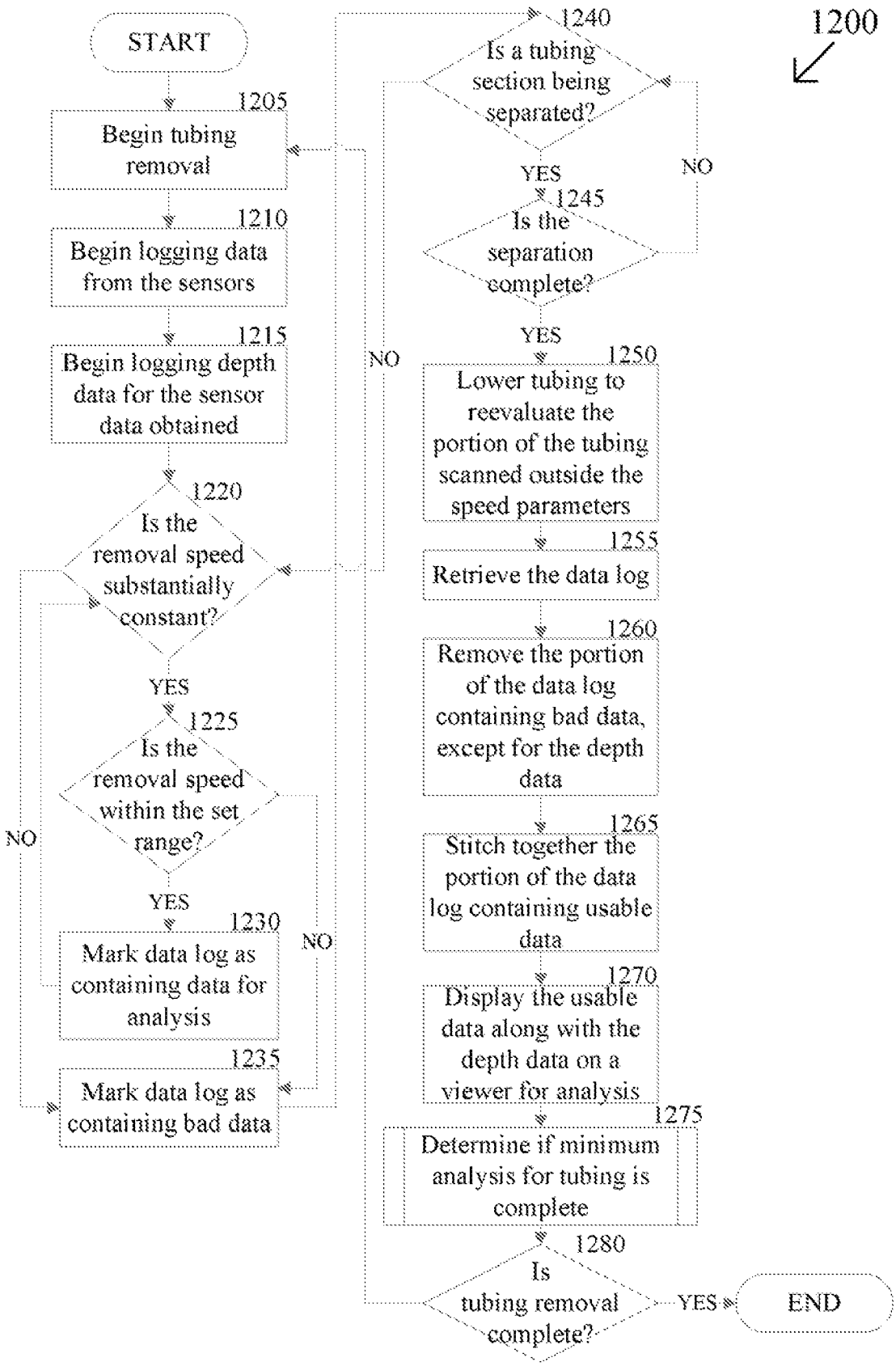
FIG. 12 is a flowchart of another exemplary process for obtaining information about tubing that is being inserted into or extracted from an oil well in accordance with one exemplary embodiment of the present invention.

FIG. 12 is a logical flowchart diagram illustrating an exemplary process 1200 for obtaining information about tubing 125 that is being inserted into or extracted from an oil well 175 as shown and described within the operating environment of the exemplary workover rig 140 and tubing scanner 150 of FIGS. 1 and 2. Now referring to FIGS. 1, 2, and 12, the exemplary method 1200 begins at the START step and proceeds to step 1205, where the rig 140 begins to remove the tubing 125 from the well 175. The computer 130 begins to log data from the sensors in the tubing scanner 150 in step 1210. In one exemplary embodiment, the sensors can include rod wear sensors 205, pitting sensors 255, weight sensors (not shown) that can also be located outside of the tubing scanner 150, and ultrasonic sensors (not shown).

In step 1215, the computer 130 begins to log depth data associated with the sensor data obtained in step 1210. In one exemplary embodiment, the depth data is obtained from the encoder 115, however, other depth or positional sensors or devices may be used to determine the depth the tubing 125 was at during the operation of the well 175. In step 1220, an inquiry is conducted to determine if the removal speed of the tubing section 125 is substantially constant. The tubing speed can be determined by evaluating a signal sent from the encoder 115 along the drum 110 to the computer 130. In one exemplary embodiment, the computer 130 is programmed with the allowable tolerances for the tubing speed in order to determine if the speed range is considered substantially constant. If the tubing speed is not substantially constant, the "NO" branch is followed to step 1235. Otherwise, the "YES" branch is followed to step 1225.

In step 1225, an inquiry is made by the computer 130 to determine if the removal speed is within the set range. In one exemplary embodiment, the optimum removal speed is between two and four feet per minute, however other speeds above and below that range may be used, and analysis speeds may be dependent on the type of tubing 125 being removed and the capabilities of the sensors used to analyze the tubing 125. If the removal speed is within the set range, the "YES" branch is followed to step 1230, where the analysis data being retrieved is "marked" as containing data for analysis. The process then returns to step 1220. On the other hand, if the removal speed is not within the set range, the "NO" branch is followed to step 1235, where the analysis data is "marked" as containing bad data. The marking of the data can be accomplished as previously described herein.

In step 1240, an inquiry is conducted to determine if the tubing section 125 is being separated from the remainder of the tubing 125 in the well 175. If not, the "NO" branch is followed to step 1220. Otherwise, the "YES" branch is followed to step 1245 in step 1245, an inquiry is conducted to determine if the separation of the tubing section 125 is complete. If not, the "NO" branch is followed to step 1240. On the other hand, if the separation is complete, the "YES" branch is followed to step 1250, where the rig 140 lowers the tubing 125 to reevaluate the portion of the tubing 125 scanned outside of the speed parameters while the rig 140 was slowing to a stop for removal of the tubing section 125. In one exemplary embodiment, based on the positional or depth data provided by the encoder 115, the computer 130 can provide sufficient information to inform the oilfield service operator of the amount to lower the tubing 125. In another exemplary embodiment, the computer 130 can be communicably connected to the rig 140 through known control means and the computer 130 can lower the tubing 125 the by the amount determined from the analysis of bad data.

In step 1255, the computer 130 retrieves the data log. The computer 130 removes the portion of the data log containing bad data in step 1260. However in this step, the depth data is kept, and maintained for display on the viewer. In step 1265, the computer 130 stitches together the portion of the data log containing "good" or usable data. The stitching process is similar to that described earlier herein. The usable data is displayed along with depth data on a viewer for analysis in step 1270. In step 1275, the computer 130 determines if a minimum analysis for the tubing 125 has been collected. In step 1280, an inquiry is conducted to determine if the tubing removal is complete. If not, the "NO" branch is followed to step 1205 for removal of additional tubing sections 125. Otherwise, the "YES" branch is followed to the END step.

Figure 13:
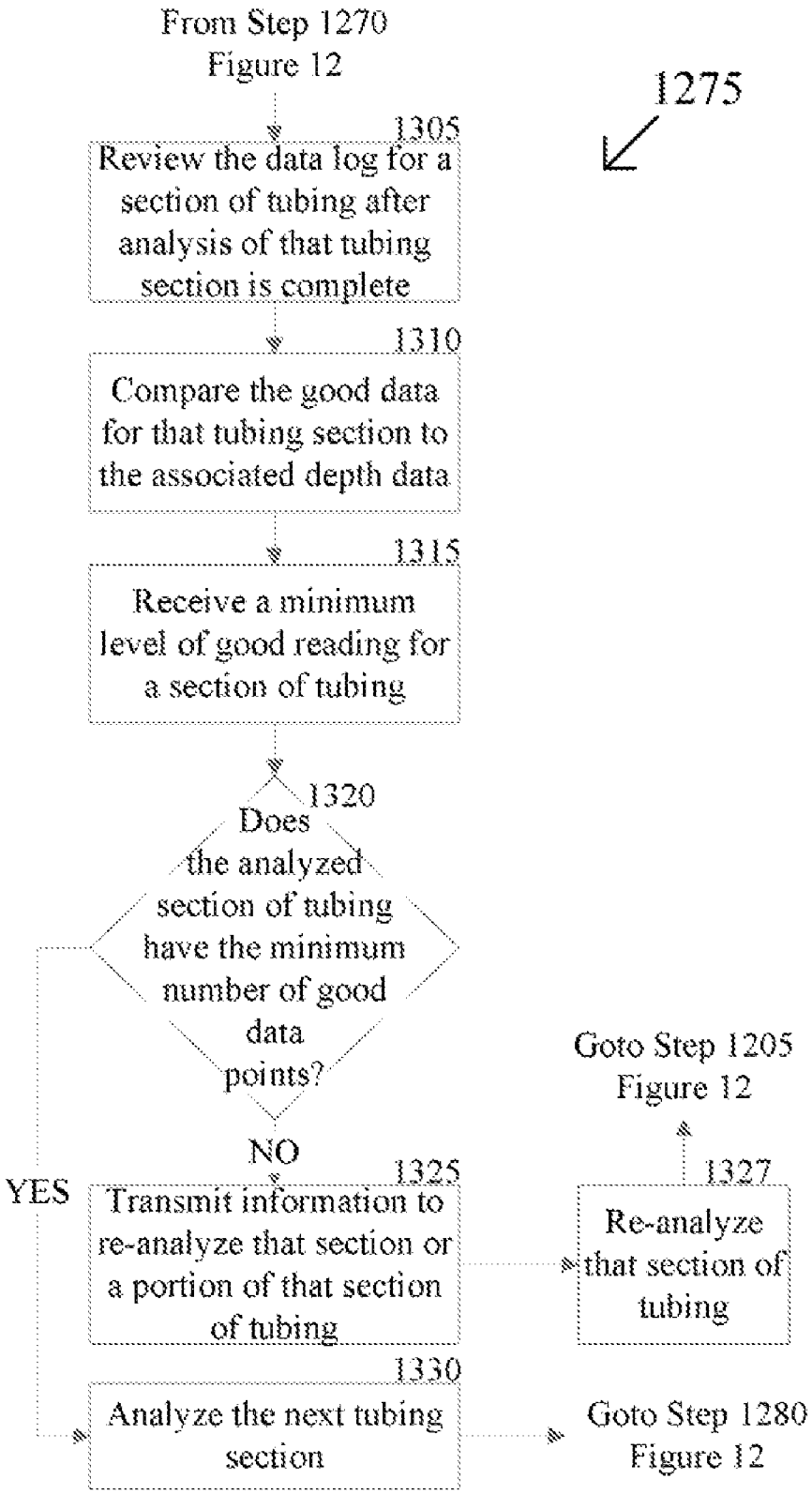
FIG. 13 is a flowchart of an exemplary process for determining if a minimum level of usable data point have been obtained in an analysis of a section of tubing in accordance with one exemplary embodiment of the present invention.

FIG. 13 is a logical flowchart diagram illustrating an exemplary process for determining if minimum analysis levels for tubing have been completed as completed by step 1275 of FIG. 12. Now referring to FIGS. 1, 2, 12, and 13, the exemplary method 1275 begins at step 1305, where the computer 130 reviews the data log for a section of tubing 125 after analysis of that tubing section 125 is complete. In this exemplary embodiment, the tubing section is a single piece of tubing, however amount of tubing analyzed is variable and can be programmed based on the amount of tubing 125 withdrawn from the well 175 during a single removal process. In step 1310, the computer 130 compares the usable data for the analyzed tubing section 125 to the associated depth data.

In step 1315, the computer 130 receives an input describing the minimum level of usable data readings that need to be received from each section of tubing 125. The input can include requirements that a base level of usable readings be obtained from the tubing section 125, a base level of usable reading be obtained from a portion of the tubing section 125 or both. In one exemplary embodiment, the computer 130 is programmed to determine if at least one usable data reading is received for each one-sixteenth of the length of the piece of tubing or tubing section 125. Those of ordinary skill in the art will recognize that the selection of the amount of readings and the length of tubing sections 125 for the selected amount of readings is variable and can be chosen and modified based on the local factors for each particular tubing 125 removal process.

In step 1320, an inquiry is conducted by the computer 130 to determine if the analyzed section of tubing has the required number of usable data readings. Following the example described above, the computer 130 would analyze the depth data for the tubing section 125 and could determine based on depth location if at least one usable data reading was received for each one-sixteenth linear section of tubing 125. If the minimum was not attained, the "NO" branch is followed to step 1325, where the computer 130 or other analysis device transmits information to re-analyze that section or a portion of that section of tubing 125. The transmission could take the form or a visual or audible signal on a control panel, a message displayed on a viewer, or other methods known to those of ordinary skill in the art. In step 1327, the tubing section 125 is re-analyzed. The process then returns to step 1205. Returning to step 1320, if the minimum was attained, then the "YES" branch is followed to step 1330 where analysis of the next tubing section can begin. The process then proceeds to step 1280 of FIG. 12.

In summary, an exemplary embodiment of the present invention describes methods for analyzing a section of tubing at a substantially constant predetermined speed and displays the data in a way such than grading the tubing is easier and more consistent that the prior grading methods. In addition, based upon the improved grading, the method of chemically treating wells can be analyzed and revised in order to extend the life of the tubing in the wells.

From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is to be limited only by any claims that may follow.

The invention claimed is:

1. A method for evaluating at least one tubing section at a wellsite comprising a well, comprising the steps of:

raising at least one tubing section from the well;

scanning the tubing section with at least one sensor to receive a plurality of quality data for evaluating at least one quality indicator for tubing as at least a portion of the tubing section is being raised from the well;

receiving the plurality of quality data;

receiving a speed that the tubing section is being raised from the well;

identifying a first portion of the quality data received while the speed of raising the tubing section was a substantially constant speed; and displaying the first portion of the quality data on a display device, wherein the display of the first portion of the quality data has a beginning point and an end point.

2. The method of claim 1, further comprising the steps of:

identifying a second portion of the quality data received while the tubing section was not moving at a substantially constant speed; and stopping the display of quality data on the display.

3. The method of claim 2, further comprising the steps of:

identifying another first portion of the quality data received while the tubing section was moving at the substantially constant speed subsequent to the identification of the second portion of the quality data being received while the tubing section was not moving at a substantially constant speed; and restarting the display of quality data on the display device at a position substantially adjacent to the end point of the display of the first portion of the quality data.

4. The method of claim 3, further comprising the step of determining a quality grade for the tubing section based on the first portion and the another first portion of the data displayed on the display device.

5. The method of claim 4, further comprising the step of marking the tubing section with the quality grade.

6. The method of claim 5, further comprising the step of organizing the tubing sections based on the quality grade each of the tubing sections received.

7. The method of claim 4, further comprising the step of automatically inserting the quality grade for the tubing section into a spreadsheet application.

8. The method of claim 2, further comprising the step of initiating an alert that the speed is not substantially constant.

9. The method of claim 8, wherein the alert comprises an audible alarm.

10. The method of claim 8, wherein the alert comprises a message displayed on the display device.

11. The method of claim 1, wherein the display device is located on a well service rig.

12. The method of claim 1, wherein the display device is located at a location remote from the wellsite and wherein the method further comprises the step of sending the first portion of the quality data to the display device.

13. The method of claim 12, wherein the first portion of the quality data is sent to the display device at the location remote from the wellsite via the internet.

14. The method of claim 12, wherein the first portion of the quality data is sent to the display device at the location remote from the wellsite via satellite transmission from the wellsite.

15. The method of claim 1, further comprising the steps of:

accepting a tubing analysis speed; and determining if the tubing section was moving at the substantially constant speed, wherein the substantially constant speed comprises a speed range that includes the tubing analysis speed.

16. The method of claim 15, wherein the tubing analysis speed is received from an input device at a well service rig.

17. The method of claim 15, further comprising the steps of:

determining a distance needed to accelerate the tubing section to the tubing analysis speed; and positioning a top end of the tubing section below the sensors at least the distance needed to accelerate the tubing section to the tubing analysis speed.

18. The method of claim 1, further comprising the steps of:

identifying a second portion of the quality data received while the tubing section was not moving at a substantially constant speed;

initially displaying the second portion of the quality data on the display device, wherein the display of quality data comprises a plurality for first portions of the quality data and a plurality of second portions of the quality data;

determining that the quality data has been received for a lower end of the tubing section;

removing the plurality of second portions of the quality data from the display device; and substantially piecing together the plurality of first portions of the quality data on the display at the display device.

19. The method of claim 1, further comprising the steps of:

identifying a second portion of the quality data received while the speed was not moving at the substantially constant speed;

displaying the plurality of the quality data on the display device, the plurality of quality data comprising the first portion and the second portion of the quality data;

wherein the first portion of the quality data is displayed on the display device in a first color and the second portion of the quality data is displayed on the display device in a second color.

20. The method of claim 1, wherein the sensor comprises one of the following: a wall thickness sensor, a rod wear sensor, a collar locating sensor, a crack sensor, a pitting sensor, and an imaging sensor.

21. A method for evaluating at least one tubing section at a wellsite comprising a well, comprising the steps of:

raising at least one tubing section from the well;

scanning the tubing section with at least one sensor to receive a plurality of quality data for evaluating at least one quality indicator for tubing as at least a portion of the tubing section is being raised from the well;

receiving the plurality of quality data;

displaying the plurality of quality data on a display device;

identifying a first portion of the quality data received while the tubing section was not moving at a substantially constant speed; and removing the first portion of quality data from the display of quality data on the display device.

22. A method for evaluating at least one tubing section at a wellsite comprising a well, comprising the steps of:

raising at least one tubing section from the well;

scanning the tubing section with at least one sensor to receive a plurality of quality data for evaluating at least one quality indicator for tubing as at least a portion of the tubing section is being raised from the well;

receiving the plurality of quality data;

receiving a plurality of depth data; wherein the depth data comprises a depth of the tubing section in the well prior to the tubing section being raised;

associating each quality data point with the depth data;

determining if an actual tubing analysis speed is substantially equal to a desired tubing analysis speed for each of the plurality of quality data;

identifying a first portion of the quality data and its associated depth data received while the actual tubing analysis speed was substantially equal to the desired tubing analysis speed;

identifying a second portion of the quality data and its associated depth data received while the actual tubing analysis speed was not substantially equal to the desired tubing analysis speed; and displaying the first portion of the quality data at its associated depth on a chart displayed on the display device, wherein the chart comprises at least one depth axis.

23. The method of claim 22 further comprising the step of accepting a desired tubing analysis speed from an input device at a well service rig.

24. The method of claim 22, further comprising the step of lowering a tubing section comprising a top end and a bottom end such that the top end is positioned below at least one sensor configured to generate the plurality of quality data.

25. The method of claim 22, further comprising the step of stopping the display of quality data on the display for the second portion of the quality data.

26. The method of claim 25, further comprising the steps of:

identifying another first portion of the quality data received while the tubing section was moving at the substantially constant speed subsequent to the identification of the second portion of the quality data being received;

restarting the display of quality data on the display device at a position substantially adjacent to an end point of the display of the first portion of the quality data.

27. The method of claim 22, further comprising the steps of:

displaying the second portion of the quality data on the display device;

wherein the first portion of the quality data is displayed on the display device in a first color and the second portion of the quality data is displayed on the display device in a second color.

28. The method of claim 22, further comprising the steps of:

initially displaying the second portion of the quality data on the display device where the display of quality data comprises a plurality for first portions of the quality data and a plurality of second portions of the quality data;

determining that the quality data has been received for a lower end of the tubing section;

removing the plurality of second portions of the quality data from the display device; and positioning the plurality of first portions of the quality data adjacent to one another on the display at the display device.

29. The method of claim 22, further comprising the step of displaying the associated depth data for the second portion of the quality data without displaying the second portion of the quality data on the display at the display device.

30. A method for evaluating at least one tubing section at a wellsite comprising a well, comprising the steps of:

raising at least one tubing section from the well;

scanning the tubing section with at least one sensor to receive a plurality of quality data for evaluating at least one quality indicator for tubing as at least a portion of the tubing section is being raised from the well;

receiving the plurality of quality data;

receiving a plurality of depth data; wherein the depth data comprises a depth of the tubing section in the well prior to the tubing section being raised;

associating each quality data point with a depth data point;

creating a log of the quality data and depth data;

determining if an actual tubing analysis speed is within a desired tubing analysis speed range for each of the plurality of quality data;

identifying a first portion of the quality data and its associated depth data received while the actual tubing analysis speed was within the desired tubing analysis speed range;

designating the first portion of the quality data as comprising quality data suitable for analysis;

identifying a second portion of the quality data and its associated depth data received while the actual tubing analysis speed was not within the desired tubing analysis speed range;

designating the second portion of the quality data as comprising quality data not suitable for analysis;

retrieving the log of the quality data and depth data;

displaying the first portion of the quality data and its associated depth data on a display device; and displaying the associated depth data for the second portion of the quality data without displaying the second portion of the quality data on the display device.

31. The method of claim 30, further comprising the step of determining if a minimum analysis threshold of quality data has been displayed on the display device.

32. The method of claim 31, wherein determining if a minimum analysis threshold of quality data has been displayed on the display device comprises determining if a minimum number of quality data points is displayed on the display device.

33. The method of claim 31, further comprising the step of transmitting a signal to re-analyze the tubing section based on a negative determination that the minimum analysis threshold of quality data has been displayed on the display device.

34. The method of claim 30, further comprising the steps of:

lowering at least a portion of the tubing section below the sensor to at least a depth where the second portion of the quality data was obtained from the tubing section; and receiving another plurality of quality data for the tubing section.

35. A method for evaluating at least one tubing section at a wellsite comprising a well, comprising the steps of:

raising at least one tubing section from the well;

scanning the tubing section with at least one sensor to receive a plurality of quality data for evaluating at least one quality indicator for tubing as at least a portion of the tubing section is being raised from the well;

receiving an actual speed that the tubing section is being raised;

receiving the plurality of quality data;

determining if the actual speed that the tubing section is being raised is within a desired tubing analysis speed range for each of the plurality of quality data;

identifying a first portion of the quality data received while the tubing section was moving at a substantially constant speed; and displaying the first portion of the quality data on a display device.

36. The method of claim 35, wherein the first portion of quality data comprises all of the quality data received for the tubing section while the actual speed that the tubing section was being raised was within the desired tubing analysis speed range.

37. The method of claim 35, further comprising the step of accepting a desired tubing analysis speed from an input device.

38. The method of claim 37, wherein the desired tubing analysis speed range is derived from the desired tubing analysis speed received from the input device, wherein the desired tubing analysis speed is within the desired tubing analysis speed range.

39. The method of claim 35, further comprising the step of determining a quality grade for the tubing section based on the first portion of the quality data displayed on the display device.

40. A system for obtaining and displaying tubing scan data comprising:

a tubing scanner comprising a plurality of sensors for sensing a tubing section and providing scan data;

a speed sensor providing an indication of a speed the tubing section is being raised;

means for displaying scan data; and a computing device in electronic communication with the tubing scanner, the speed sensor, and said means for displaying scan data; wherein the computing device receives the scan data and displays the scan data on the means for displaying the scan data when the speed from the speed sensor indicates the tubing section is being raised within a desired speed range.

41. The system of claim 40, further comprising an input means in electronic communication with the computing device, the input means receiving a desired speed for raising the tubing section and communicating the desired speed to the computing device.

* * * * *